US011148895B2

(12) United States Patent
Morelli et al.

(10) Patent No.: US 11,148,895 B2
(45) Date of Patent: Oct. 19, 2021

(54) REWINDING MACHINE AND METHOD OF PRODUCING LOGS OF WEB MATERIAL

(71) Applicant: FABIO PERINI S.P.A., Lucca (IT)

(72) Inventors: Roberto Morelli, S. Maria a Colle (IT); Franco Montagnani, Palaia (IT); Romano Maddaleni, Pientina (IT)

(73) Assignee: Fabio Perini S.p.A., Lucca (IT)

( * ) Notice: Subject to any disclaimer, the term of this patent is extended or adjusted under 35 U.S.C. 154(b) by 164 days.

(21) Appl. No.: 16/271,963

(22) Filed: Feb. 11, 2019

(65) Prior Publication Data

US 2019/0168979 A1 Jun. 6, 2019

Related U.S. Application Data

(63) Continuation-in-part of application No. 15/500,316, filed as application No. PCT/EP2015/067516 on Jul. 30, 2015, now abandoned.

(30) Foreign Application Priority Data

Jul. 31, 2014 (IT) ..... FI2014A000181

(51) Int. Cl.
*B65H 18/20* (2006.01)
*B65H 19/22* (2006.01)
*B65H 19/26* (2006.01)

(52) U.S. Cl.
CPC ..... *B65H 19/2269* (2013.01); *B65H 18/20* (2013.01); *B65H 19/267* (2013.01); *B65H 2301/41358* (2013.01); *B65H 2301/41376* (2013.01); *B65H 2301/41822* (2013.01); *B65H 2301/41824* (2013.01); *B65H 2402/31* (2013.01); *B65H 2408/235* (2013.01)

(58) Field of Classification Search
CPC .. B65H 19/267; B65H 19/2269; B65H 18/20; B65H 2408/235
See application file for complete search history.

(56) References Cited

U.S. PATENT DOCUMENTS 5,979,818 A 11/1999 Perini et al.
6,098,916 A * 8/2000 Matteucci ..... B65H 19/2269 242/527.3
6,648,266 B1 11/2003 Biagiotti et al.
(Continued)

FOREIGN PATENT DOCUMENTS

EP 0853060 A1 7/1998
EP 0968946 A1 1/2000
(Continued)

*Primary Examiner* — Sang K Kim
(74) *Attorney, Agent, or Firm* — Breiner & Breiner, L.L.C.

(57) ABSTRACT

The rewinding machine includes a first winding cradle formed between a first winding roller, a second winding roller and a third winding roller. The first winding roller and the second winding roller define a nip through which there pass the winding cores with the web material being wound around them. The rewinding machine also includes a feed path of the winding cores that pass between the first winding roller and the third winding roller. A second winding cradle is formed between the first winding roller, the second winding roller and a fourth winding roller. The rewinding machine also includes a rolling surface extending around the first winding roller and defining a feed channel of the winding cores.

33 Claims, 15 Drawing Sheets

(56) References Cited

U.S. PATENT DOCUMENTS

| | | | | |
|---|---|---|---|---|
| 7,942,363 | B2 | 5/2011 | Gelli et al. | |
| 2007/0176039 | A1* | 8/2007 | Gelli | B65H 18/26 242/533.3 |
| 2013/0221150 | A1* | 8/2013 | Morelli | B65H 19/2269 242/522 |
| 2016/0001997 | A1* | 1/2016 | Maddaleni | B65H 19/26 242/523.1 |
| 2017/0210584 | A1* | 7/2017 | Morelli | B65H 19/267 |

FOREIGN PATENT DOCUMENTS

| | | | |
|---|---|---|---|
| JP | 63-057463 | A | 3/1988 |
| JP | 63-057463 | A | 3/1998 |
| WO | 2007083336 | A2 | 7/2007 |
| WO | 2011104737 | A1 | 9/2011 |
| WO | 2012042549 | A1 | 4/2012 |

* cited by examiner

REWINDING MACHINE AND METHOD OF PRODUCING LOGS OF WEB MATERIAL

RELATED APPLICATIONS

This application is a continuation-in-part application of Ser. No. 15/500,316 filed Jan. 30, 2017, which is a National phase application under 35 U.S.C. 371 of International Application No. PCT/EP2015/067516 filed Jul. 30, 2015, which claims priority of Italian Application No. FI2014A000181 filed Jul. 31, 2014. Each of the above-noted applications are incorporated herein by reference.

TECHNICAL FIELD

The present invention relates to methods and machines for producing logs of web material, in particular but not exclusively logs of paper, in particular tissue paper, for example rolls of toilet tissue, kitchen towels or the like.

STATE OF THE ART

In the field of paper manufacturing, in particular for the production of rolls of toilet tissue, kitchen towels or the like, large reels (parent reels) of tissue paper coming directly from the continuous production machine are wound. These large reels are subsequently unwound and rewound to produce rolls or logs with smaller diameters, corresponding to the diameters of the end product destined for the market. These logs have an axial length equal to a multiple of the finished roll destined for distribution and for sale and are subsequently cut by cutting machines to obtain the end product destined to be packaged and subsequently marketed.

To produce logs of web material, modern rewinding machines provide for the use of winding rollers that, in various combinations and arrangements, and with suitably controlled rotation, allow logs to be produced automatically in rapid sequence through continuous feed of the web material. At the end of winding of a log, the log must be moved away from the winding area and the web material must be severed (by cutting, tearing or the like), to allow winding of a subsequent log to start. Normally, winding takes place around winding cores, typically but not exclusively made of cardboard, plastic or another similar suitable material. In some cases, winding takes place around extractable and recyclable mandrels, i.e. which are extracted from the completed log after winding has been completed, to be reinserted into the rewinding machine in order to wind a subsequent log.

In winding machines of more modern design, the winding movement is imparted to the logs being formed by means of contact with two or more rollers rotating at controlled speed. These rewinding machines are called peripheral or surface rewinding machines, as the winding movement is imparted peripherally through the contact between the surface of the winding rollers and the surface of the logs being formed. Examples of automatic continuous surface rewinding machines of this type are disclosed in U.S. Pat. No. 5,979,818 and in other patents of the same family, and in the patent literature cited in this patent. An improvement to the machine described in this US patent is described in WO-A-2011/104737 and in WO2007/083336. In these prior art winding machines, severing of the web material is performed by means of a severing, tearing or cutting member, which cooperates with a fixed axis winding roller, around which the web material is fed, and which defines, together with a second winding roller, a nip for inserting the winding cores into a winding cradle.

These machines are also defined as continuous and automatic, as the various steps of the winding cycle of each log follow one another automatically, passing from the production of one log to the next, without interrupting the feed of the web material and at an approximately constant or substantially constant speed. The term automatic continuous rewinding machine is used in the present description and in the appended claims to indicate this type of machine.

One of the critical steps in automatic continuous peripheral rewinding machines of the type described above consists in the change-over step, i.e. the step of severing the web material, discharging the completed log and starting to wind a new log around a new winding core inserted into the winding cradle.

Various solutions have been studied to perform these operations automatically and rapidly, for example through the use of winding rollers rotating at controlled speed that accelerate and/or decelerate in synchronism in order to favor correct movement of the completed logs and of the new cores. In some cases, tearing systems are provided, in which the web material is severed at the end of winding by means of a difference in speed. In other cases, pressurized air systems, suction systems, mechanical systems or the like are used to perform severing of the web material.

WO-A-2012/042549 describes a peripheral automatic rewinding machine with four rollers. The use of four rollers, all or at least some with movable axes, allows two winding cradles to be defined and more efficient control of the log being formed. In some embodiments described in that document, the log being formed is always in contact with at least three winding rollers and in some cases it can be temporarily in contact with four winding rollers. This allows particularly efficient control of the winding cycle, of the shape of the log and of the winding density to be obtained. In some embodiments the web material is severed by lengthening the path of the web material between two winding rollers. Lengthening causes the web material to break, forming the free trailing edge of a complete log and a free leading edge to start winding the subsequent log on a new core. Although this machine achieves particularly appreciable results in terms of winding accuracy and operating reliability, there are some aspects that could be further improved. In particular, correct operation and reproducibility of the winding cycle in some cases can depend on the properties of the material being processed, i.e. of the web material and/or of the winding cores.

SUMMARY OF THE INVENTION

According to the present disclosure, there is provided a rewinding machine with four rollers, of automatic continuous peripheral type, in which logs of web material are wound in rapid sequence around winding cores, without interrupting the feed of the web material, i.e. feeding the web material continuously or substantially continuously to a winding head, which comprises, in addition to the winding rollers, also a mechanism for severing of the web material at the end of each winding cycle.

By continuous or substantially continuous feed it is intended here that the web material has a feed speed that is substantially independent from the winding cycle, it being understood that other factors can, even substantially, modify the feed speed of the web material. For example, when a parent reel from which the web material is dispensed, must be replaced, or when the web material breaks, it may be necessary to slow or even stop feed of the web material to the winding head. However, this variation of speed or stop is not correlated to the winding cycle of the single logs.

According to one aspect, an automatic continuous peripheral rewinding machine for producing logs of web material wound around winding cores is provided, comprising a first winding cradle formed between a first winding roller, a second winding roller and a third winding roller. The first winding roller and the second winding roller define a nip through which the winding cores with the web material wound around them pass. The rewinding machine can also comprise a winding cores feed path that extends between the first winding roller and the third winding roller. Advantageously, a second winding cradle is also provided, formed between the first winding roller, the second winding roller and a fourth winding roller. The third winding roller is positioned upstream of the nip and the fourth winding roller is positioned downstream of the nip, with respect to the direction of feed of the winding cores through the nip. The rewinding machine can comprise a rolling surface for the winding cores, extending partially around the first winding roller toward the third winding roller. Between the rolling surface and the first winding roller an insertion, i.e. feed, channel for the winding cores is defined. In the rewinding machine there can be defined a feed path for the web material which extends between the first winding roller and the third winding roller and between the first winding roller and the second winding roller. The rolling surface is configured and arranged with respect to the first winding roller so that the cores are fed by rolling in contact with the rolling surface and with the web material driven around the first winding roller.

In the context of the present description and of the appended claims, coherently with the meaning given to this term in the field of converting of paper and other endless web materials, and in particular according to the terminology of rewinding machine manufacturers, the term winding roller is intended as a motorized roller, i.e. a roller which is rotated positively by means of a motor, to transmit the winding movement to the log being formed by friction between the surface of the winding roller and the log, which contacts said winding roller.

The arrangement of the winding rollers is such as to allow, for example, winding of the logs of web material by co-action always of three winding rollers in contact with the log being formed. Moreover, the particular arrangement of the third winding roller with respect to the insertion path of the cores and of the web material, which extends between the third winding roller and the first winding roller, as well as through the nip between the first winding roller and the second winding roller, which separates the first winding cradle with respect to the second winding cradle, can allow the winding rollers to be suitably dimensioned, to process also winding cores of small diameter.

In advantageous embodiments, the rewinding machine comprises a web material severing member configured and controlled to sever the web material at the end of winding of a log in the second winding cradle. For example, the severing member can be configured and controlled to cooperate with the first winding roller.

In some embodiments, the severing member is configured and controlled to pinch the web material against the first winding roller and sever the web material by generating in the web material a tension greater than the breaking point of the web material.

In some embodiments, the rolling surface extends from an inlet of winding cores feed channel to the third winding roller. In this way, the winding cores are inserted in the channel, fed by rolling along said channel and around the first winding roller, with the web material between the first winding roller and the winding core being fed in the channel. The path of the winding cores then continues, beyond the insertion channel, between the first winding roller and the third winding roller, to reach the first winding cradle.

In advantageous embodiments, the rolling surface has interruptions through which a severing member can penetrate the winding cores feed channel to pinch the web material against the first winding roller. For example, the rolling surface can be formed by a comb structure, comprising a plurality of shaped laminar elements, spaced from one another. The shaped edges of the laminar elements form the rolling surface for the cores. The space between adjacent elements allows the passage of the severing member. The severing member can comprise one or more pressers that are interposed between laminar elements of the comb structure forming the rolling surface.

In some embodiments, the rolling surface can be divided into two portions. A first portion can be stationary with respect to a load-bearing structure. A second portion, positioned downstream of the first portion with respect to the direction of feed of the winding cores along the insertion channel, can be movable together with the third winding roller.

In possible embodiments, at least one of said first winding roller and second winding roller has a movable axis, to control the distance between the first winding roller and the second winding roller and the dimension of the nip between the first winding roller and the second winding roller. In some embodiments, preferably both the first winding roller and the second winding roller have a movable axis. The first winding roller and the second winding roller can have axes that move symmetrically with respect to a centerline plane passing through the nip formed between the first winding roller and the second winding roller.

In other embodiments the first winding roller can have a stationary axis while the second winding roller has a movable axis to control the dimension of the nip between the first winding roller and the second winding roller.

The diameters of the four winding rollers could be different from one another. Preferably, it is advantageous for the first winding roller to have a diameter larger than the second winding roller.

In some embodiments the movement of the first, second, third and fourth winding rollers during forming of the log is controlled so that: a first part of winding of the log takes place with the log in contact with the first winding roller, the second winding roller and the third winding roller; a second part of winding of the log takes place with the log in contact with the first winding roller, the second winding roller, the third winding roller and the fourth winding roller; a third part of winding of the log takes place with the log in contact with the first winding roller, the second winding roller and the fourth winding roller.

According to a further aspect, there is provided a method for winding a web material and forming in sequence logs of said web material wound around winding cores, comprising the steps of:

arranging four winding rollers defining a first winding cradle between a first winding roller, a second winding roller and a third winding roller, and a second winding cradle between said first winding roller, the second winding roller and a fourth winding roller;

arranging a rolling surface extending around the first winding roller and forming therewith a feed channel for the winding cores;

feeding the web material around the first winding roller;

inserting a first winding core into the feed channel and feeding said first winding core along an insertion path between the first winding roller and the third winding roller and inserting the first winding core into the first winding cradle;

carrying out a first part of a winding cycle of a first log around a first winding core in the first winding cradle, transferring the first log being formed from the first winding cradle into the second winding cradle through a nip defined between the first winding roller and the second winding roller;

carrying out a second part of a winding cycle of the first log in the second winding cradle;

at the end of winding of the first log in the second winding cradle, inserting a second winding core into the feed channel and along the insertion path that extends between the first winding roller and the third winding roller and inserting the second winding core into the first winding cradle.

In some embodiments, the method can comprise the steps of inserting the second winding core against the first winding roller pinching the web material between the second winding core and the first winding roller, and severing the web material between the first log in the second winding cradle and the second winding core.

The method can comprise the steps of: providing a web material severing member; and acting through said severing member on the web material to sever the web material thus generating a trailing edge of the first log and a leading edge with which to start winding a second log around the second winding core. The two edges can be generated between the second core and the first log nearing completion of winding.

In some embodiments, the method can comprise one or more of the following steps of: arranging the rolling surface around the first winding roller, defining an insertion channel for the winding cores between the first winding roller and the rolling surface, the rolling surface extending from an inlet of the insertion channel for the winding cores to the third winding roller; inserting the second winding core into the insertion channel and feeding the second winding core by rolling along the insertion channel, in contact with the rolling surface and with the web material driven around the first winding roller, until reaching the third winding roller; passing the second winding core between the first winding roller and the third winding roller; inserting the second winding core, with a second log being wound there around, into the first winding cradle.

A possible embodiment of the method according to the invention provides for the following steps:

a) inserting a first winding core toward the first winding cradle, in contact with the web material entrained around the first winding roller and in contact with the rolling surface;

b) fastening a leading edge of the web material to the first winding core;

c) winding a part of a log of web material maintaining the first winding core in the first winding cradle, and feeding the first winding core toward the second winding cradle;

d) passing the first winding core, with the log being wound there around, through the nip between the first winding roller and the second winding roller and transferring the first winding core with the log being formed there around into the second winding cradle and completing winding of the log of web material in said second winding cradle;

e) inserting a second winding core toward the first winding cradle, in contact with the web material entrained around the first winding roller and with the rolling surface;

f) severing the web material forming a leading edge of web material, by means of the severing member and discharging the log of web material from the second winding cradle;

g) repeating steps (b) to (f) to form a further log around said second winding core, without interrupting the feed of the web material.

A further embodiment of the method according to the invention can comprise the following steps:

a) arranging the third winding roller in an initial position for receiving a first winding core;

b) bringing a first winding core into contact with the web material guided around the first winding roller and angularly accelerating the first winding core moving it toward the first winding cradle;

c) fastening a leading edge of the web material to the first winding core;

d) feeding the first winding core between the first winding roller and the third winding roller into the first winding cradle and winding a part of a log of web material maintaining the first winding core in the first winding cradle, and feeding the first winding core toward the second winding cradle;

e) passing the first winding core, with the log being wound there around, through the nip between the first winding roller and the second winding roller, the third winding roller moving from the initial position toward the nip between the first winding roller and the second winding roller following the log being formed and in movement in the first winding cradle and toward the second winding cradle;

f) transferring the first winding core with the log being formed there around into the second winding cradle g) completing winding of the log of web material in the second winding cradle;

h) returning the third winding roller to the initial position;

i) bringing a second winding core into contact with the web material entrained around the first winding roller;

j) severing the web material forming a leading edge of web material, by means of the severing member with the third winding roller in the initial position, and discharging the log of web material from the second winding cradle;

k) repeating the steps (c) to (j) to form a further log around said second winding core, without interrupting the feed of the web material.

In yet a further embodiment, the method can comprise the steps of:

arranging the rolling surface around the first winding roller, forming with the first winding roller the feed channel of the winding cores;

at the end of winding of a log, inserting a new winding core into the feed channel in contact with the rolling surface and with the web material entrained around the first winding roller, angularly accelerating the winding core in the feed channel;

inserting the severing member into the feed channel, downstream of the new winding core, causing breaking of the web material between the new winding core and the log nearing completion of winding in the second winding cradle.

BRIEF DESCRIPTION OF DRAWINGS

The invention will be better understood by following the description and accompanying drawing, which shows non-limiting practical embodiments of the invention. More specifically, in the drawing.

DETAILED DESCRIPTION OF EMBODIMENTS

Figure 1:
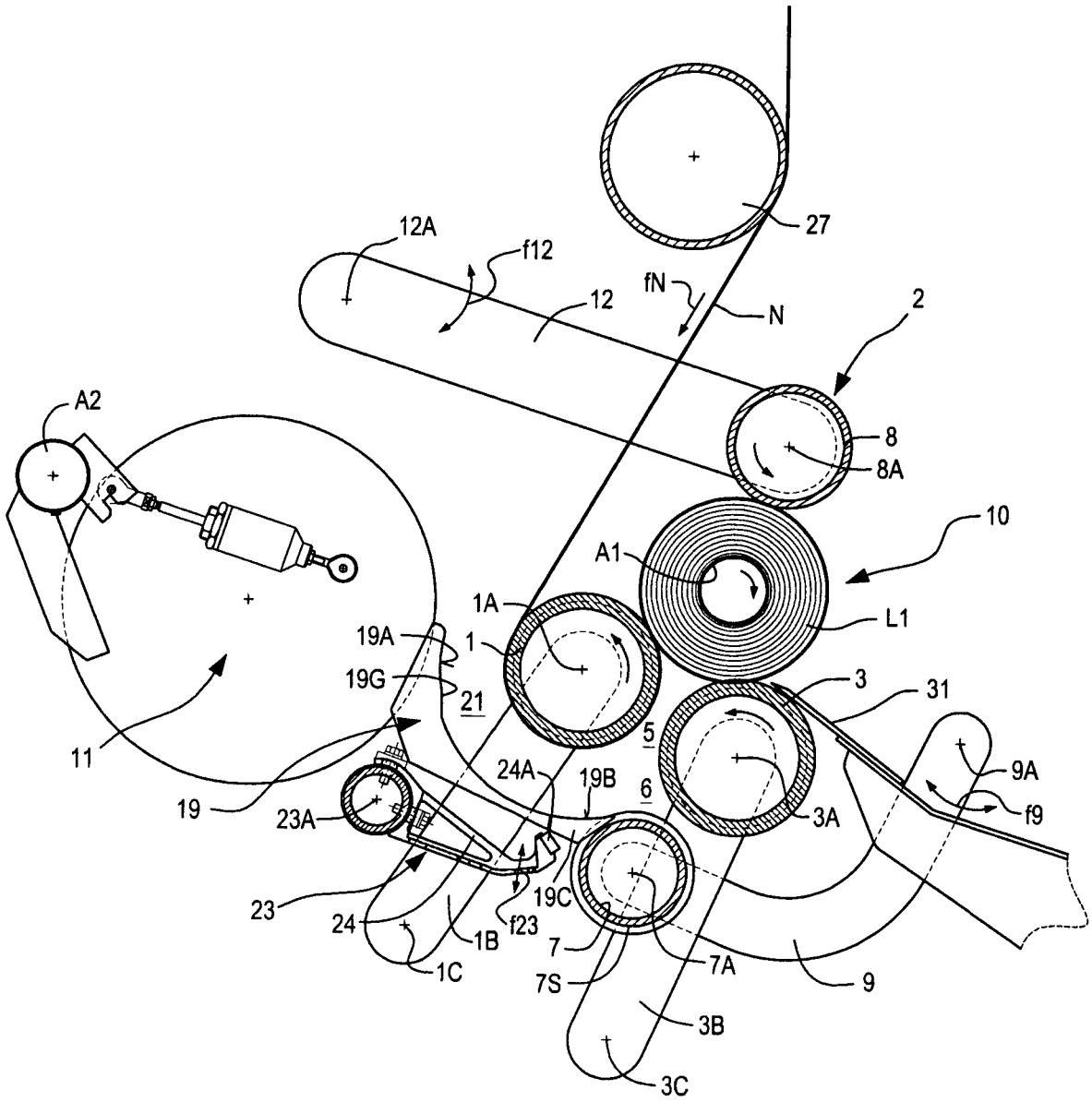
FIGS. 1 to 5 schematically show a first embodiment of a rewinding machine according to the invention in an operating sequence.

FIGS. 1 to 5 show an embodiment of a continuous peripheral rewinding machine according to the invention and an operating sequence that shows in particular the change-over step, i.e. the step of discharging a log, winding whereof has been completed, and inserting a new winding core to start formation of a subsequent log.

FIGS. 1 to 5 show the main elements of the rewinding machine, limited to those necessary to understand the concepts on which the invention is based and an operating mode of the machine. Construction details, auxiliary units and further components, known and/or that can be designed according to the prior art, are not shown in the drawing or described in greater detail. Those skilled in the art may provide these further components on the basis of their experience and knowledge of the field of paper converting machinery.

In brief, in the embodiment shown herein, the machine, indicated as a whole with 2, comprises a first winding roller 1 with a rotation axis 1A, arranged side by side with a second winding roller 3 having a rotation axis 3A. The axes 1A and 3A are substantially parallel to each other. Between the two winding rollers 1 and 3 there is defined a nip 5, through which there is fed (at least during a part of the winding cycle of each log) a web material N to be wound around winding cores A1, A2 around which logs L1, L2 are formed. The path of the web material N extends around the first winding roller 1, wrapping it partially, so that the web material N is in contact with the cylindrical surface of the winding roller 1 for a certain arc of contact, which can vary during the winding cycle, as will be apparent from the description of the winding process.

As will be apparent from the description herein below, the winding cores also pass through the winding nip 5 during an intermediate step of the winding cycle.

The winding cores A1, A2 are inserted into the machine upstream of the nip 5, into a first winding cradle 6, formed by the first winding roller 1, by the second winding roller 3 and by a third winding roller 7. The reference 7A indicates the rotation axis of the third winding roller 7, substantially parallel to the axes 1A and 3A of the first winding roller 1 and of the second winding roller 3, respectively.

Winding of web material N around the winding cores ends when the winding cores are located in a second winding cradle 10 positioned downstream of the nip 5 with respect to the direction of feed of the winding cores in the winding head formed by the winding rollers. The second winding cradle is formed by the first winding roller 1, by the second winding roller 3, and by a fourth winding roller 8. The reference 8A indicates the rotation axis of the fourth winding roller 8, which is substantially parallel to the axes of the winding rollers 1, 3, 7. The reference 12 indicates a pair of arms pivoted in 12A, which support the fourth winding roller 8. The double arrow f12 indicates the pivoting movement, i.e. the reciprocating rotation movement of the arm 12 and consequently of the fourth winding roller 8. By moving around the fulcrum 12A the winding roller 8 can move toward or away from the nip 5 defined between the first winding roller 1 and the second winding roller 3.

In other embodiments, the fourth winding roller 8 can be carried by a system of slides moving on linear guides, instead of by arms pivoted around a pivoting axis. Also in this case, the translation movement along the linear guides allows the winding roller 8 to move toward and away from the nip 5.

In the present description and in the appended claims, the definition "upstream" and "downstream" in relation to the position of the winding rollers refers to the direction of feed of the web material and of the axis of the winding cores, unless otherwise specified.

The third winding roller 7 is provided with a movement toward and away from the winding nip 5. For this purpose, in some embodiments the third winding roller 7 is supported by a pair of arms 9 pivoted about an axis 9A to oscillate, i.e. rotate with a reciprocating motion, according to the double arrow f9. In other embodiments, not shown, the third winding roller 7 can be supported by slides moving on linear guides, so as to follow, for example, a trajectory of rectilinear motion.

Upstream of the winding nip 5, of the first winding roller 1 and of the second winding roller 3, a core feeder or inserter 11 is arranged, which can be made in any suitable manner and inserts single winding cores A1, A2 toward the first winding cradle, as will be described in greater detail with reference to the sequence of FIGS. 1 to 5.

The winding cores can come from a "corewinder", i.e. from a machine for forming winding cores, associated with the converting line of the web material N in which the rewinding machine 2 is inserted, and not shown.

In some embodiments, the rewinding machine comprises a rolling surface 19 for the winding cores. The rolling surface 19 can have a roughly cylindrical shape, approximately coaxial to the first winding roller 1 with movable axis, when this is in the position of FIG. 1. The rolling surface 19 can have a step 19G in an intermediate position of its extension. The rolling surface 19 can be divided into a first portion 19A and into a second portion 19B, the first positioned upstream of the second, with respect to the direction of feed of the web material N.

The rolling surface 19 and the cylindrical surface of the first winding roller 1 form a feed channel 21 for the winding cores A1, A2. When the first winding roller 1 is in the position of FIGS. 1 to 4, the height of the feed channel 21 for the winding cores can be smaller in the first portion of the feed channel and larger in the second portion of the feed channel 21. The purpose of this variation of the height of the feed channel 21 is to facilitate the start of a rolling motion of each new winding core A1, A2, inserted in the feed channel 21 by the inserter or feeder 11, as will be explained herein below. In particular, in the first portion of the feed channel 21, the height of the feed channel, i.e. the distance between winding roller 1 and rolling surface 19, can be smaller than the diameter of the winding cores A1, A2.

In some embodiments, the rolling surface 19 is formed by a comb structure, with a plurality of arched plates arranged side-by-side with one another, between which free spaces are formed. Through these free spaces between adjacent plates forming the rolling surface 19 there can be inserted a severing member of the web material N, indicated as a whole with 23. In some embodiments, the comb structure forms the first part 19A of the rolling surface and can be stationary, i.e. fixed with respect to a supporting structure, not shown. In some embodiments, a second part 19B of the rolling surface can be formed by elements 19C that move with the axis 7A of the third winding roller 7, following the movement of this latter.

The elements 19C can also be plates forming a comb structure.

In other embodiments, the surface 19B can be formed by a single arched plate, which extends transversely with respect to the feed movement of the web material, i.e. parallel to the axes of the winding rollers 1, 3, 7.

In some embodiments, the severing member 23 comprises a presser, for example including a plurality of presser members 24. The severing member 23 can be provided with a reciprocating rotational movement, about an axis 23A, approximately parallel to the axes of the winding rollers 1, 3. Reference f23 indicates the movement of the severing member 23. Each presser member can have a pressing pad 24A. The pressing pad 24A can be made, for example, of elastically yielding material preferably with a high coefficient of friction, for example rubber.

In a manner synchronized with the movement of the other members of the machine, as will be better illustrated herein below with reference to an operating cycle, the severing member 23 is pressed against the first winding roller 1 to pinch the web material N between the pads 24A of the presser members 24 and the surface of the first winding roller 1. This latter can have a surface with annular bands having a high coefficient of friction and annular bands having a low coefficient of friction. In this context, the terms "high" and "low" are intended to indicate a relative value of the coefficients of friction of the two series of alternating annular bands. The bands with low coefficient of friction can advantageously be arranged in the areas in which the pads 24A of the presser members 24 press. In this way, when the web material N is pinched against the first winding roller 1 by the presser members 24, it tends to be stopped by the pads 24A and to slide on the annular bands with low coefficient of friction of the first winding roller 1.

FIG. 1 shows a final step of the winding cycle of a first log L1. As shown in FIG. 1, during this step of the winding cycle of a first log L1 around a first winding core A1 the log L1 is located in the second winding cradle 10, in contact with the first winding roller 1, the second winding roller 3 and the fourth winding roller 8. The web material N is fed, according to the arrow fN around the first winding roller 1, through the nip 5 between the first winding roller 1 and the second winding roller 3 and is wound on the log L1 being formed, which is rotated by the rollers 1, 3 and 8 and retained thereby in the winding cradle 10. Reference 27 indicates a guide roller for the web material N positioned upstream of the winding head defined by the winding rollers 1, 3, 7 and 8.

Preferably, the feed speed of the web material N is substantially constant. Substantially constant is intended as a speed that varies slowly with respect to the winding speed and as a consequence of factors that are independent from the operations performed by the members of the winding head described above, which are controlled so as to perform the winding cycle, discharge the formed log, insert the new core and start winding a new log at a constant feed speed of the web material toward the cluster of winding rollers and in particular toward the first winding roller 1.

Durante winding of the log L1, outside the change-over step, which forms a transitional step in the operation of the machine, the peripheral speeds of the winding rollers 1, 3, 7 and 8 are substantially the same as one another and the various winding rollers all rotate in the same direction, as indicated by the arrows in the drawing. In this case, substantially the same means that the speed can vary limited to the needs to control the compactness of winding and the tension of the web material N between the winding roller 7 and the winding roller 8, for example to offset the variation in tension that could be caused by the movement of the center of the log being formed along the path between the winding rollers.

In some embodiments, this difference between peripheral speeds of the winding rollers can typically be comprised between 0.1 and 1% and preferably between 0.15 and 0.5%, for example between 0.2 and 0.3%, it being understood that these values are examples and are not limiting.

Moreover, the peripheral speeds can vary slightly to cause the advancing movement of the log being formed, as clarified below, in order for it to pass from the first winding cradle 6 to the second winding cradle 10.

The winding cycle of the logs is as follows.

In FIG. 1 the log L1 in the winding cradle 10 formed by the rollers 1, 3, 8 has practically been completed, with winding of the required amount of web material N around the first winding core A1. The quantity of wound web material can be determined by a winding length. A second winding core A2 has been brought by the winding cores feeder or inserter 11 at the inlet of the feed channel 21.

The reference C indicates a continuous line or a series of dots of glue applied to the outer surface of the second winding core A2.

Figure 2:
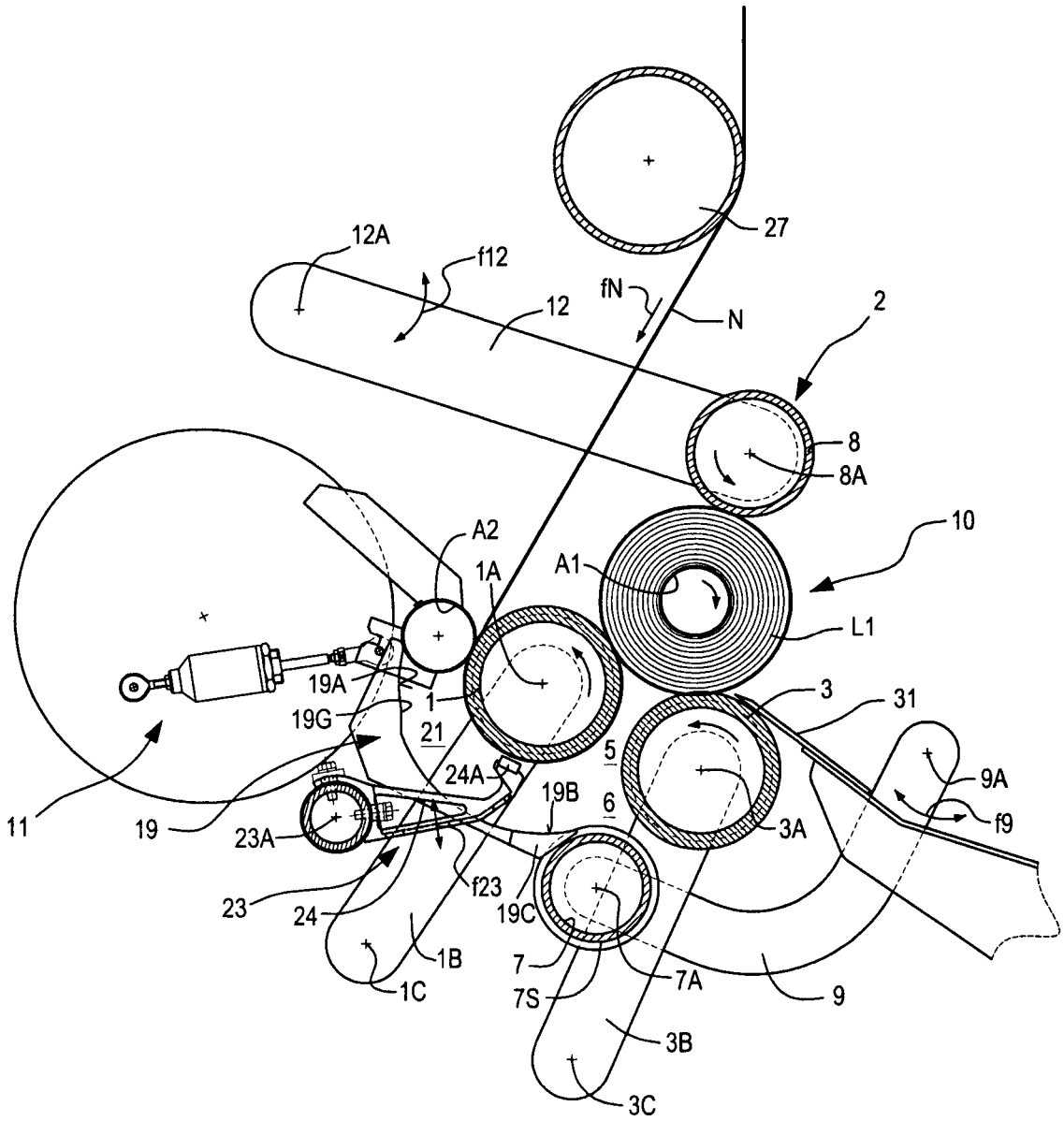

FIG. 2 shows the start of the change-over step, i.e. of discharge of the completed log L1 and insertion of the new winding core A2 into the winding head formed by the rollers 1, 3, 7, 8.

The second winding core A2 is inserted by the winding cores feeder or inserter 11 into the inlet of the feed channel 21 defined between the first winding roller 1 and the rolling surface 19.

The position of the first winding roller 1 in this step of the winding cycle is such that it is about coaxial to the generally and approximately cylindrical rolling surface 19. The distance between the portion 19A of the rolling surface 19 and the cylindrical surface of the first winding roller 1 is slightly less than the diameter of the winding core A2. In this way, the winding core A2 entering the feed channel 21 is pressed against the rolling surface 19 and against the web material N driven around the first winding roller 1.

This pressure generates a friction force between the surface of the winding core A2 and the rolling surface 19, and between the surface of the winding core A2 and the web material N entrained around the cylindrical surface of the first winding roller 1. This ensures that, as a result of the rotation movement of the first winding roller 1 and of feed of the web material N, the winding core A2 accelerates angularly, starting to roll along the rolling surface 19, pushed by the web material N and by the first winding roller 1 against which the web material N is pressed.

Along the second portion 19B of the rolling surface 19, the radial dimension of the feed channel 21 can increase gradually, thus reducing deformation of the diameter of the winding core A2 and allowing winding of the web material N around it to start, with consequent formation of turns of a new log.

The step 19G, if provided, can facilitate the initial angular acceleration phase of the winding core A2.

Durante the rolling movement of the winding core A2 in the feed channel 21, the line of glue C applied to the winding core A2 comes into contact with the web material N, causing adhesion of the web material N to the winding core.

In this step of the winding cycle, breaking or severing of the web material N also takes place by means of the severing member 23. This latter is made to pivot against the first winding roller 1, so as to pinch, with the pads 24A, the web material N against the surface of the first winding roller 1. As the winding rollers 1, 3 and 8 continue to rotate winding the web material N on the log L1, the web material is stretched between the log L1 and the pinch point of the web material N against the first winding roller 1 by the severing member 23.

Figure 3:
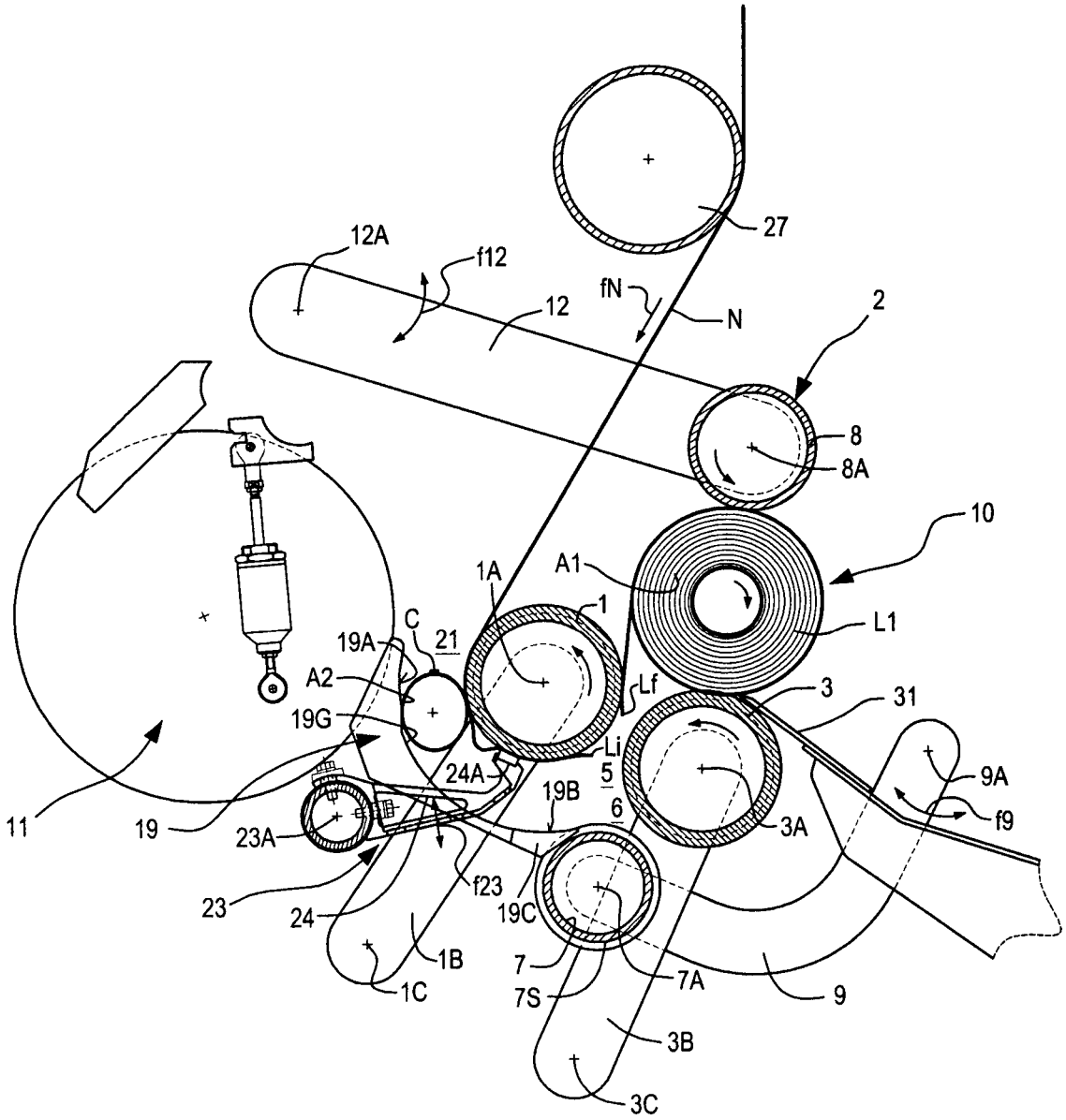

When the tension exceeds the breaking point, for example at a perforation line of the web material N, this latter breaks generating a trailing edge Lf, which is wound on the log L1, and a leading edge Li, which is wound on the new winding core A2. The leading and trailing edges Li and Lf are schematically shown in FIG. 3. In this embodiment of the winding method, when severing of the web material N is performed, the winding core A2 passes through the portion of smaller radial dimension of the insertion channel 21 of the winding cores A2, i.e. at the step 19G. In other embodiments, severing of the web material N can take place before or after passage of the winding core A2 over the step 19G.

In some embodiments, winding can start without the use of glue C, for example by electrostatically charging the web material N and/or the winding core A2, or using a suction system, optionally inside the winding core A2, which can be provided with suction holes. In other embodiments, winding can start with the aid of air jets. In yet other embodiments, start of winding can be obtained or facilitated through suitable control of the movement of the severing member 23. For example, the severing member can be controlled to form a loop of web material N, which is wound around the winding core.

While in the sequence of FIGS. 1 to 5, the movement of the severing member 23 is alternating reciprocating movement, in other embodiments the movement of the severing member 23 can be always in the same direction, for example clockwise in the drawing. The speed of the severing member can be controlled so as to cause breaking or severing of the web material between the pinch point of the web material N by the pads 24A and the log L1, for example by rotating the severing member 23 with a speed so that the pads 24A are fed at a lower speed than the peripheral speed of the first winding roller 1. In other embodiments, the speed of the pads 24A can be greater than the peripheral speed of the first winding roller 1. In this case, breaking or severing of the web material N can take place between the pinch point of the web material N by the pads 24A and the pinch point of the web material N between the first winding roller 1 and the new winding core A2.

In other embodiments, not shown, the severing member can be configured differently, and perform, for example, cutting of the web material, using a blade that cooperates with a counter-blade on the first winding roller 1. In yet other embodiments, severing of the web material can be obtained with a severing member housed in the first winding roller 1 or between this latter and the path of the web material N, the severing member being configured and controlled to sever the web material acting from the side of the web material N facing the winding roller 1.

Figure 4:
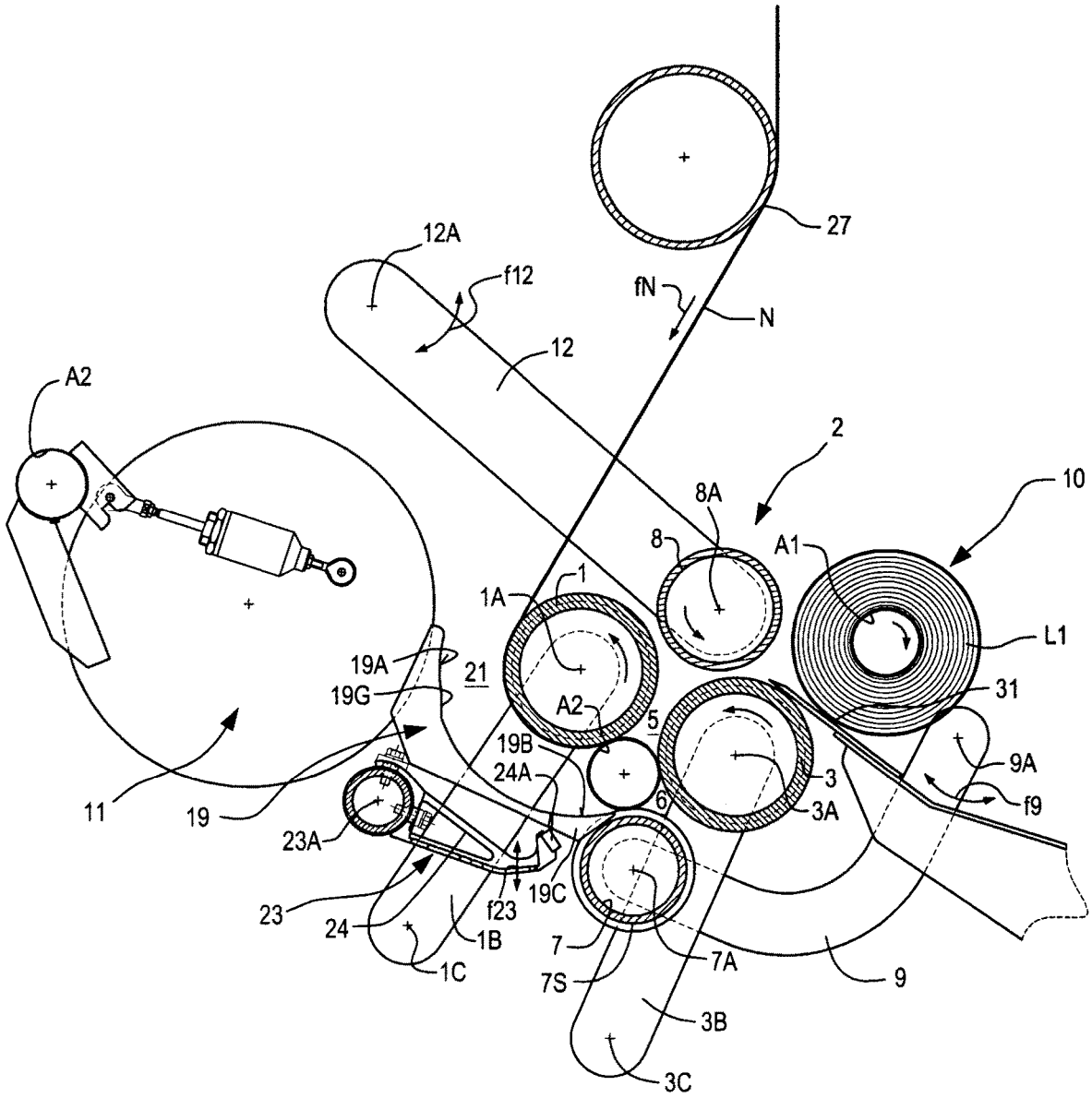

FIG. 4 shows the subsequent step, in which the second winding core A2, rolling along the rolling surface 19, leaves the rolling surface 19 and comes into contact with the cylindrical surface of the third winding roller 7, which is located at the end of the insertion channel 21 for the winding cores.

The third winding roller 7 can be provided with a series of annular grooves 7S, into which the ends of the plates that form the terminal part 19B of the rolling surface 19 are inserted. In this way, the winding core A2 is gently transferred from the rolling surface 19 to the surface of the third winding roller 7.

Rolling on the surface of the third winding roller 7 and remaining in contact with the web material N driven around the first winding roller 1, the winding core A2, or more precisely the new log L2 that starts to form there around, also comes into contact with the second winding roller 3, as shown in FIG. 4. Therefore, in practice the path of the winding cores extends between the first winding roller 1 and the third winding roller 5 and through the nip 5 between the first winding roller 1 and the second winding roller 3.

To allow feed of the winding core A2 along the feed channel 21, the severing member 23 is rotated around the axis 23A until it exits from the feed channel 21. The glue C (or another means or member for starting winding) has caused adhesion of the web material N to the winding core A2, so that the web material starts to wind on the winding core A2 starting the formation of a second log L2 while the core is fed by rolling along the channel 21.

During the operations described above, the first log L1 starts the movement of ejection from the second winding cradle 10, for example as a result of a variation of the peripheral speeds of the rollers 1, 3 and 8. In some embodiments the fourth winding roller 8 can be accelerated and/or the second winding roller 3 can be decelerated to cause the log L1 to move away from the second winding cradle 10 toward a discharge chute 31. The fourth winding roller 8 moves upward to allow passage of the log L1 toward the discharge chute 31.

In FIG. 4 the second winding core A2 is located in the first winding cradle 6 and is in contact with the first winding roller 1, the second winding roller 3 and the third winding roller 7 and the second log L2 is being formed there around. The completed log L1 is discharged on the chute 31. The second winding core A2 passes through a nip or space defined between the first winding roller 1 and the third winding roller 7, before coming into contact with the second winding roller 3. Subsequently, as described below, the winding core A2 with the log L2 being formed there around also passes through the nip 5 between the first winding roller 1 and the second winding roller 3.

Forming of the second log L2 continues through feed of the web material N around the new winding core A2 and consequent increase of the diameter of the new log L2. The third winding roller 7 can move due to the movement of the arms 9 around the fulcrum or axis 9A, following the increase of diameter of the second log L2. The portion 19B of the rolling surface 19 can follow the movement of the third winding roller 7, so as not to obstruct the movement of this latter toward the nip 5 between the first winding roller 1 and the second winding roller 3.

After having performed a part of the winding cycle in the cradle 6, the log L2 is moved to the second winding cradle 10 where winding of the log is completed. For this purpose, it is necessary to pass the log L2 through the nip 5. To do this, in some embodiments one or preferably both the winding rollers 1 and 3 can be supported by respective arms 1B, 3B such as to pivot around axes of oscillation 1C, 3C.

Figure 5:
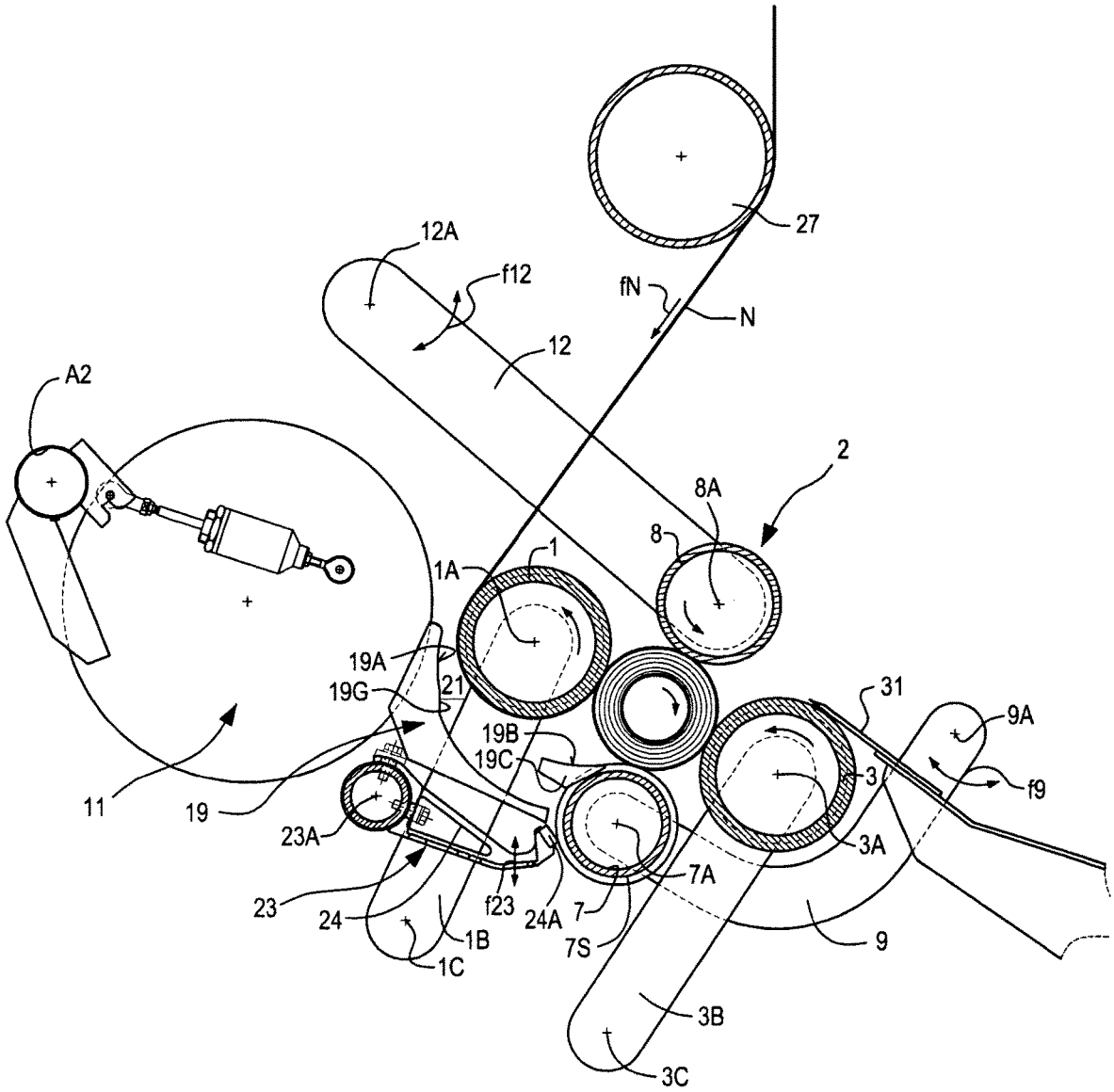

As can be seen in FIG. 5, which shows an intermediate step of the passage from the winding cradle 6 to the winding cradle 10, the distance between centers of the winding rollers 1 and 3 is gradually increased, for example by pivoting the arms 1B, 3B. In other embodiments, the winding rollers 1, 3 can be carried by slides provided with a translation movement, instead of a pivoting or rotation movement.

Whatever the mechanism used to modify the distance between centers of the winding rollers 1 and 3, their movement away from each other (FIG. 5) allows the log L2 to pass through the nip 5 and enter the winding cradle 10.

In some embodiments, during this step the third winding roller 7 can move gradually toward the second winding cradle 10, accompanying the log L2. In this way, winding continues to take place in contact with at least three winding rollers 1, 3, 7.

The fourth winding roller 8, which was raised to allow growing of the log L1 followed by discharge thereof toward the chute 31, is returned toward the nip 5 until it comes into contact with the log L2, which is fed through the nip 5. For a part of the winding cycle the log L2 can be in contact with all four winding rollers 1, 3, 7 and 8.

The third winding roller 7 can move toward the nip 5 following the log L2 until it is made to pass beyond the nip between the rollers 1 and 3. From this point on, the log L2 can be in contact only with the rollers 1, 3 and 8 and finish being wound in the second winding cradle 10.

The feed movement of the axis of the log L2 can be suitably obtained with a control of the movement of the winding rollers, which by modifying the mutual position of their axes, move the log L2 into the, and through the, area of minimum distance between the rollers 1 and 3. For example, movement can be obtained by pushing the log with the third winding roller 7. In some embodiments the movement of the log can be facilitated, supported or influenced through temporary variation of the peripheral speeds of the winding rollers, for example by decreasing the peripheral speed of the second winding roller 3 for a short time.

While the embodiment shown in FIG. 5 includes a step in which the log L2 is in contact with the four winding rollers 1, 3, 7 and 8, in other embodiments the third winding roller 7 could lose contact with the log L2 before it passes through the nip 5, beyond the point of minimum distance between the winding rollers 1 and 3, and comes into contact with the fourth winding roller 8. However, in the embodiment shown, better control of the log is obtained in the various steps of formation, as the log is always in contact with at least three winding rollers.

The time for which the second winding core A2 remains in the position of FIG. 5, i.e. in the winding cradle 6, can be controlled simply by acting on the peripheral speed of the winding rollers 1, 3 and 7 and/or on the position of the rollers. The second winding core A2 will remain substantially in this position, without being fed further, for the whole of the time in which the peripheral speeds of the winding rollers 1, 3 and 7 remain the same as one another. As mentioned above, subsequent advancement is obtained, for example, by decelerating the second winding roller 3. It is thus possible to set the amount of web material N that is wound around the winding core A2 as desired, retaining this latter and the second log L2 that is formed there around in the winding cradle 1, 3, 7 for the desired time.

Once the log L2 is located in the second winding cradle 10, winding of the second log L2 continues until reaching the condition of FIG. 1. The third winding roller 7, which can be moved toward the nip 5 to accompany the movement of the log L2 through the nip in the second winding cradle 10, can return to the initial position of FIG. 1, in which it cooperates with the severing member 23.

In some embodiments, the structure of the members of the rewinding machine is such that the path followed by the center of the winding cores A1, A2 from the time in which they come into contact with the three winding rollers 1, 3 and 7 to the time in which the log starts to be discharged between the rollers 1, 3 and 8, losing contact with the winding roller 7, is substantially rectilinear. This allows more regular winding and facilitates the use of centers that can be inserted into the opposed ends of the winding cores in order to improve control of the rotation and feed movement of the core and of the log during the winding cycle, combining the peripheral winding technique with an axial or central winding, as described, for example, in the U.S. Pat. No. 7,775,476 and in the publication US-A-2007/0176039.

With the described arrangement of the four winding rollers and the path of the winding cores between the first winding roller 1 and the third winding roller 7, it is possible to provide the first and the second winding roller 1, 3 with relatively large diameter, and such that an intermediate support is not required, even when the winding cores have a small diameter. Control of the winding cores of small diameter is nonetheless guaranteed also with winding rollers 1, 3 of relatively large diameter, as the third winding roller 7 can be provided with a smaller diameter. The lower flexural rigidity of the third winding roller 7 due to the smaller diameter of this roller can be offset using one or more intermediate supports. In some embodiments, the third winding roller 7 can be associated with a supporting and stiffening beam, which extends parallel to the axis 7A of the third winding roller 7, in an area in which this beam does not interfere with the path of the web material N and with the logs L1, L2 being formed. The beam can be positioned, for example, at the elements 19C, or in a diametrically opposite position with respect thereto, i.e. in an area in which the third winding roller 7 does not cooperate with the web material N and/or with the log L1, L2 being formed.

In the embodiment shown in the accompanying figures, the first winding roller 1 and the second winding roller 3 have substantially the same diameter and are both mounted with movable axes to increase and decrease the dimension of the nip 5, through which the logs being formed around the respective winding cores pass. In other embodiments, the winding roller 1 can be provided with a different diameter, for example larger than the winding roller 3. By increasing the diameter of the winding roller the support system of said roller can be simplified, as a larger diametrical dimension implies greater flexural rigidity.

Moreover, in some embodiments, only one of the two winding rollers 1 and 3 can have a movable axis, while the other has a fixed axis. In this way, the number of actuators required for movement of the various members of the rewinder is reduced and the law for controlling the motion of the winding rollers is simplified. If the two winding rollers 1 and 3 have different diameters, it is advantageous for the winding roller of larger diameter, for example the winding roller 1, to have a fixed axis, while the winding roller of smaller diameter has a movable axis. In this configuration the winding sequence of the web material around the winding core does not change. Winding starts in the winding cradle 6 and ends, after passage of the log being wound through the nip 5, in the second winding cradle 10.

In yet further embodiments, the winding rollers 1 and 3 can both be movable, but can carry out asymmetrical movements.

In some embodiments, the rewinding machine described above can be provided with a system of motorized centers, which engage, guide and control the winding cores during at least a part of their travel between the winding cradle 6 defined by the rollers 1, 3 and 7, upstream of the nip 5, and the winding cradle 10 formed by the rollers 1, 3 and 8, downstream of the nip 5.

Figure 6:
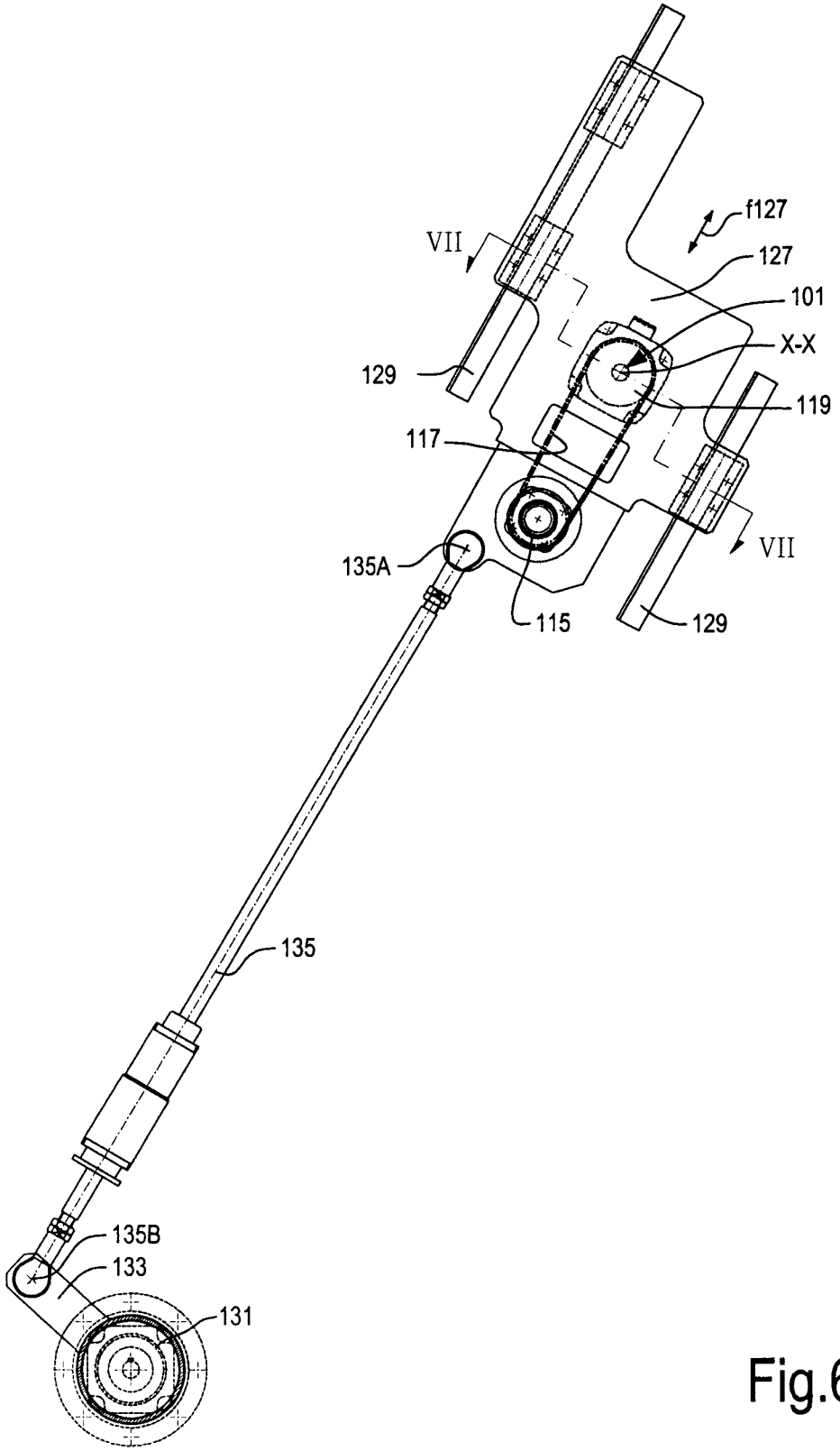
FIG. 6 shows a diagram of a system of motorized centers for guiding the winding cores.
Figure 7:
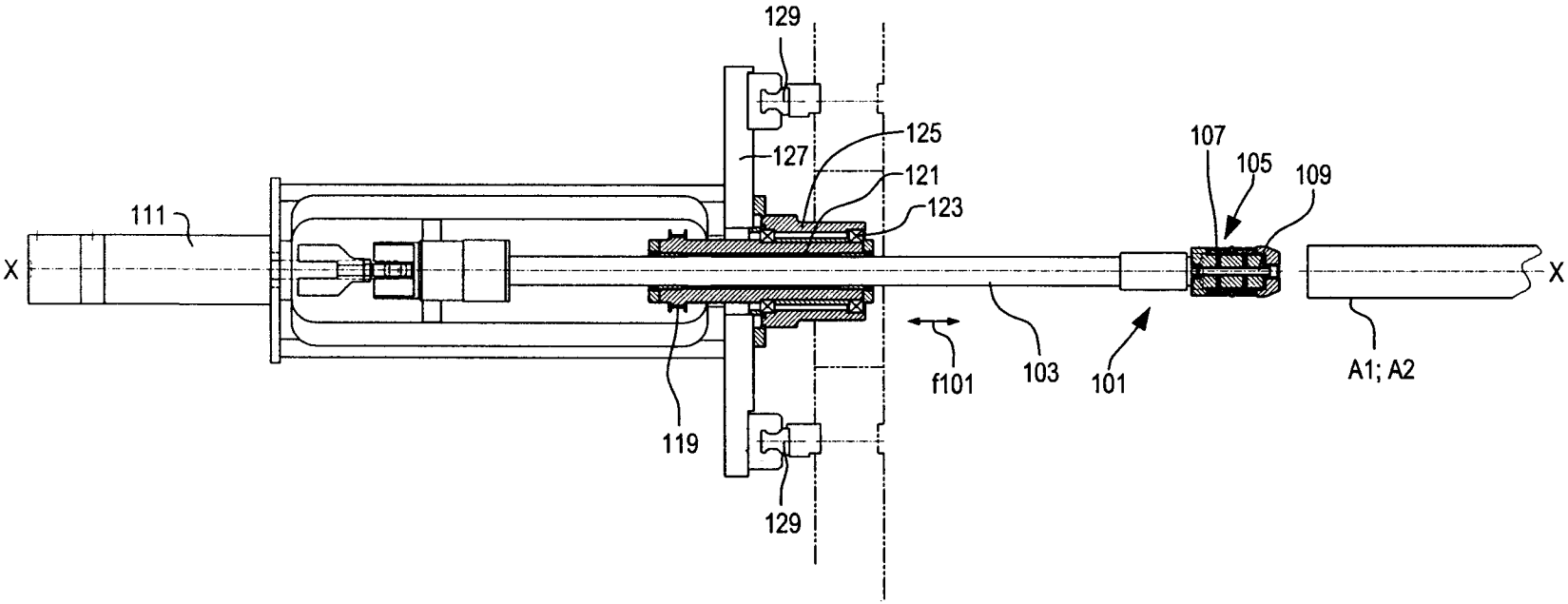
FIG. 7 shows a sectional view according to the line VII-VII of FIG. 6.
Figure 8:
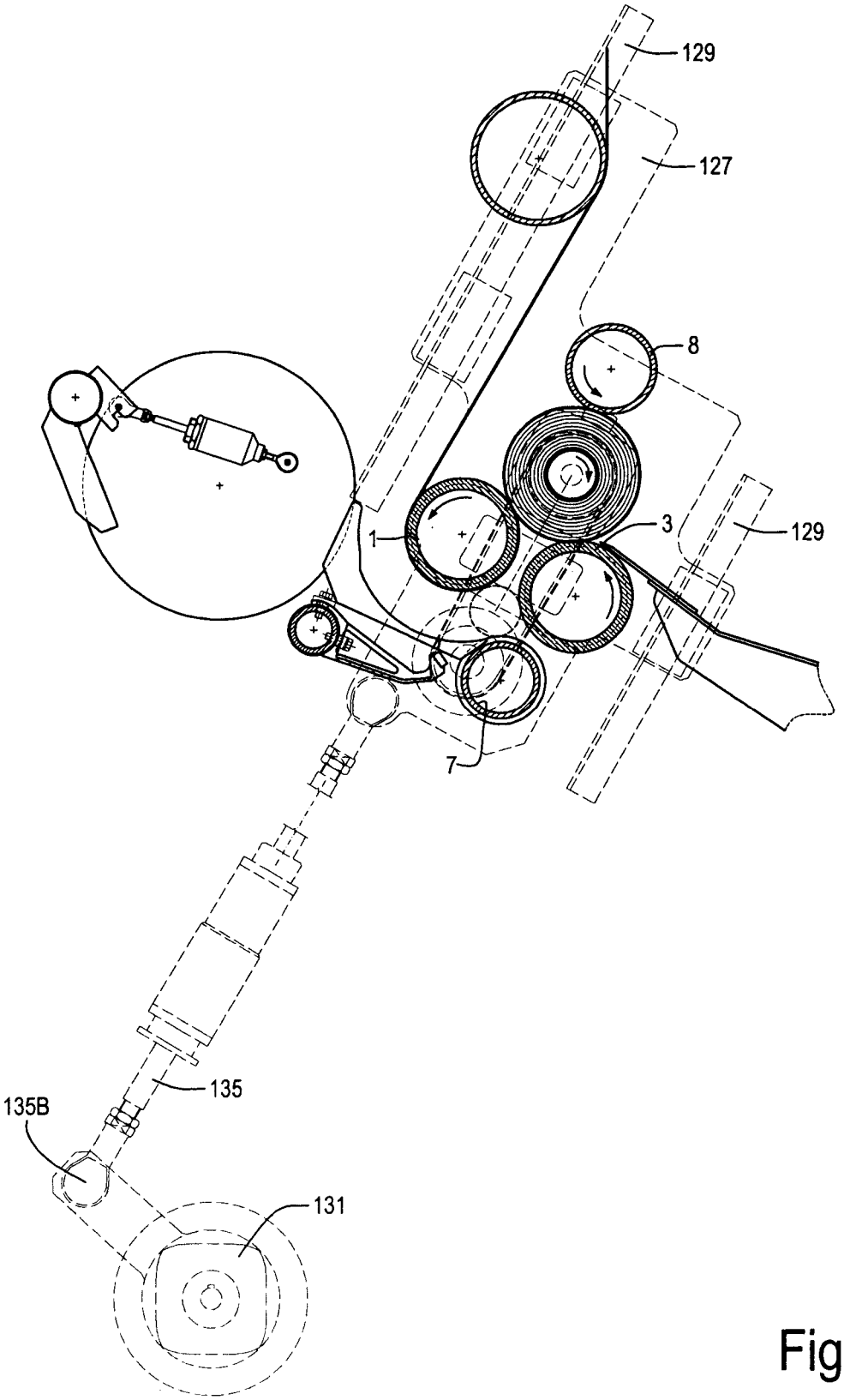
FIG. 8 shows the position of the system of FIGS. 6 and 7 with respect to the cluster of the winding rollers.

The system of centers can comprise, on each side or side member of the machine, a center 101 for engaging the respective end of a winding core A1, A2 that is inserted into the winding area. FIGS. 6 and 7 show one of these centers and the related operating mechanism.

The center 101 can have a rod 103 that ends with a head 105. The head 105 can have a mechanism to engage the tubular winding core. In some embodiments, the head 105 can engage with the winding core by being inserted therein. The head 105 can have expansible members, to torsionally engage the winding core. In some embodiments, the expansible members comprise expansible annular members 107, for example pneumatically expansible, through a compressed air feed system. The compressed air can be conveyed through ducts 109.

The center 101 can be provided with a translation movement according to arrow f101, parallel to the longitudinal axis X-X of the center.

An actuator, for example a piston-cylinder actuator 111, can be used to control the reciprocating translation movement according to the double arrow f101. This movement allows the heads 105 of opposed centers 101 on the two sides of the machine to be moved toward each other, until the heads 105 engage with the ends of the respective winding core A1, A2 that is located in the winding area. The heads 105 can be made to partially or totally penetrate the ends of the winding core.

As can be seen in particular in FIG. 6, each center 101 can be provided with a motor 115, for example an electronically controlled electric motor, which rotates the respective center 101 around its axis X-X. The motion can be transmitted from the motor 115 to the center 101 by means of a belt 117, for example a toothed belt. The toothed belt 117 can be driven around a pulley 119 torsionally constrained to the rod 103 of the respective center 101. More in particular, the pulley 119 can be fitted onto a sleeve 121, inside which the rod 103 of the center 101 can slide according to the double arrow f101, the sleeve 121 being torsionally coupled to the rod 103, for example through a grooved profile or the like. The sleeve 121 can be supported by means of bearings 123 inside a bushing 125 that can be carried by a slide 127.

The slide 127 can be mounted on stationary guides 129, i.e. integral with the load-bearing structure of the rewinding machine. In this way, the slide 127 can be translated according to the double arrow f127 in the direction defined by the guides 129. In some embodiments the rectilinear alternating movement according to f127 can be imparted by a motor 131, for example an electronically controlled electric motor. The electric motor 131 can cause the oscillation of a crank 133, wherefrom motion is transmitted through a connecting rod 135 to the slide 127, the connecting rod 135 being hinged in 135A to the slide 127 and in 135B to the crank 133.

The movement according to the double arrow f127 can be substantially rectilinear and parallel to the movement of the center of the winding core A1, A2 when this passes from one to the other of the two winding cradles definite by the sets of three rollers 1, 3, 7 and 1, 3, 8, during the winding process described above. The centers 101 can engage with the winding core A1, A2 when this is in the winding cradle 6 upstream of the nip 5 and can disengage therefrom when the log L1 is almost finished, thus allowing discharge of this latter according to the description above with specific reference to the step shown in FIGS. 3 and 4.

During the movement according to the double arrow f127, and more in particular during the step of upward movement (in the figure) of the centers 101, these accompany the winding core while the log L1 grows in diameter, while the motor 115 imparts, by means of the belt 117, a rotation movement to the centers 101, which is transmitted to the winding core and therefore to the log being formed, as a result of torsional coupling between the heads 105 of the centers 101 and the winding core A1, A2. The rotation speed imparted by the motor 115 can be controlled, so as to be coherent with the peripheral speed of the log L1 being wound.

The use of the centers 101 allows better control of winding and of the advancement of the log L1 from one to the other of the two winding cradles 6, 10 and through the nip 5 during all steps of the winding cycle.

In the embodiments shown in FIGS. 1 to 8, the first winding roller 1 and the second winding roller 3 have substantially the same diameter and can both have a movable axis, to favor passage of the core and of the web in the first winding step from the first winding cradle 6 to the second winding cradle 10. In other embodiments, the first winding roller 1 and the second winding roller 3 can have different diameters and preferably the first winding roller 1 can have a larger diameter than the second winding roller 3.

In possible embodiments, one of the winding rollers 1 and 3 can have a fixed axis and the other a movable axis.

Preferably, the first winding roller 1, around which the web material N is wound and guided, can have a fixed axis and have a larger diameter than the second winding roller 3.

FIGS. 9, 10, 11, 12, 13, 14 show a configuration of this type and a sequence of operation. The same numbers indicate the same or equivalent parts to those described with reference to FIGS. 1 to 8. In particular, the four winding rollers are indicated with 1, 3, 7 and 8. Around the first winding roller 1 there is formed a channel 21 for insertion of the winding cores A1, A2. The channel is delimited by the cylindrical surface of the first winding roller 1 and by a rolling surface 19 that extends around the first winding roller 1 and toward the third winding roller 7. The winding cores are inserted into the channel 21 so as to be in contact with the rolling surface 19 and with the web material N entrained around the first winding roller 1. The rolling surface 19 can have a sort of intermediate step, as indicated in 19G, to facilitate angular acceleration of the winding core and gripping of the web material after severing caused, in the same way as already described above, by means of a severing member 23 of the web material N. This severing member 23 of the web material cooperates with the first winding roller 1 pinching the web material between the first winding roller and one or more pressers 24A carried by the severing member 23.

The rotation axis 1A of the first winding roller 1 is stationary with respect to the load-bearing structure of the machine 1, so as to make feed of the web material N up to the nip 5 between the first winding roller 1 and the second winding roller 3 more stable and more easily controlled.

In this embodiment the second winding roller 3 has a diameter substantially smaller than the diameter of the first winding roller 1. For example, the diameter of the second winding roller 3 can be less than half the diameter of the first winding roller 1. The second winding roller 3 can be supported by lateral side members 4, as indicated schematically in FIGS. 9-14. Between the lateral side members 4 intermediate supports can be arranged, which support the second winding roller 3 in intermediate positions between the ends of this latter. In this way, it is possible to design the second winding roller 3 with a small diameter To obtain sufficient rigidity of the second winding roller 3, the side members 4 and any intermediate supports can be constrained to a transverse beam 14.

The axis 3A of the second winding roller 3 can be movable and pivot around a pivoting axis defined by a pivot point 16 of the side members 4 to the load bearing structure of the rewinding machine 2. The pivoting movement of of the second winding roller 3 can be controlled by a motor 18 associated with a crank 20. A connecting rod, also pivoted in 22B to the respective side member 4, can be pivoted in 22A to the crank 20. The reciprocating rotation movement of the motor 18 pivots the axis 3A of the second winding roller 3 around the axis defined by the pivot point 16. In some embodiments, two symmetrical motors 18 can be provided, to act on two opposed side members 4. Between the side members 4 there can be fixed the chute 31, or a part thereof, so that said chute 31 can follow the movement of the second winding roller 3.

The third winding roller 7 is carried by side members 32 constrained to a transverse beam 34 and pivoted in a pivot point 36 to the stationary structure of the rewinding machine 2. Intermediate supports can be integral with the transverse beam 34 to support the third winding roller 7 in intermediate points between the two ends thereof, supported by the side members 32. Pivoting of the third winding roller 7, i.e. the translation movement of its rotation axis 7A to follow the movement of the winding cores and of the logs being formed, can be imparted by a motor 42 by means of a connecting rod-crank system 44, 46 constrained to the transverse beam 34 in 46A.

A portion 19C of the rolling surface 19 can be constrained to the side members 32, which portion in this way can follow the translation movement of the third winding roller 7 during the various steps of the winding cycle.

Figure 9:
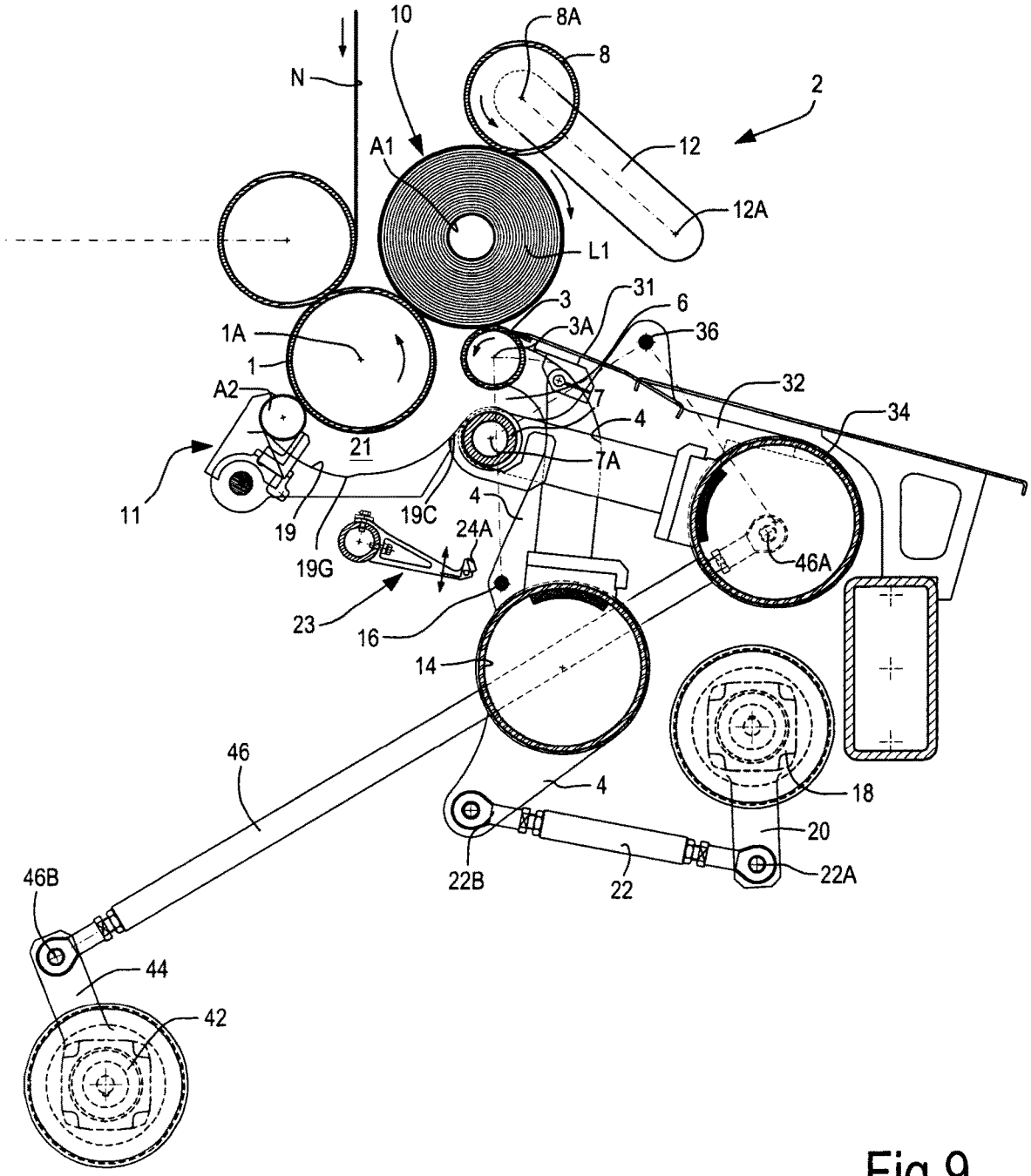
FIGS. 9-14 show a further embodiment of a rewinding machine according to the present disclosure and relevant sequence of operation.

The operating sequence of the machine 2 of FIGS. 9 to 14 is substantially the same as the one described with reference to FIGS. 1 to 5 and therefore will not be described in detail, but is self-explanatory from the sequence of FIGS. 9-14. In FIG. 9 a log L1 is under the process of winding in the second winding cradle 10 between the winding rollers 1, 3 and 8.

Figure 10:
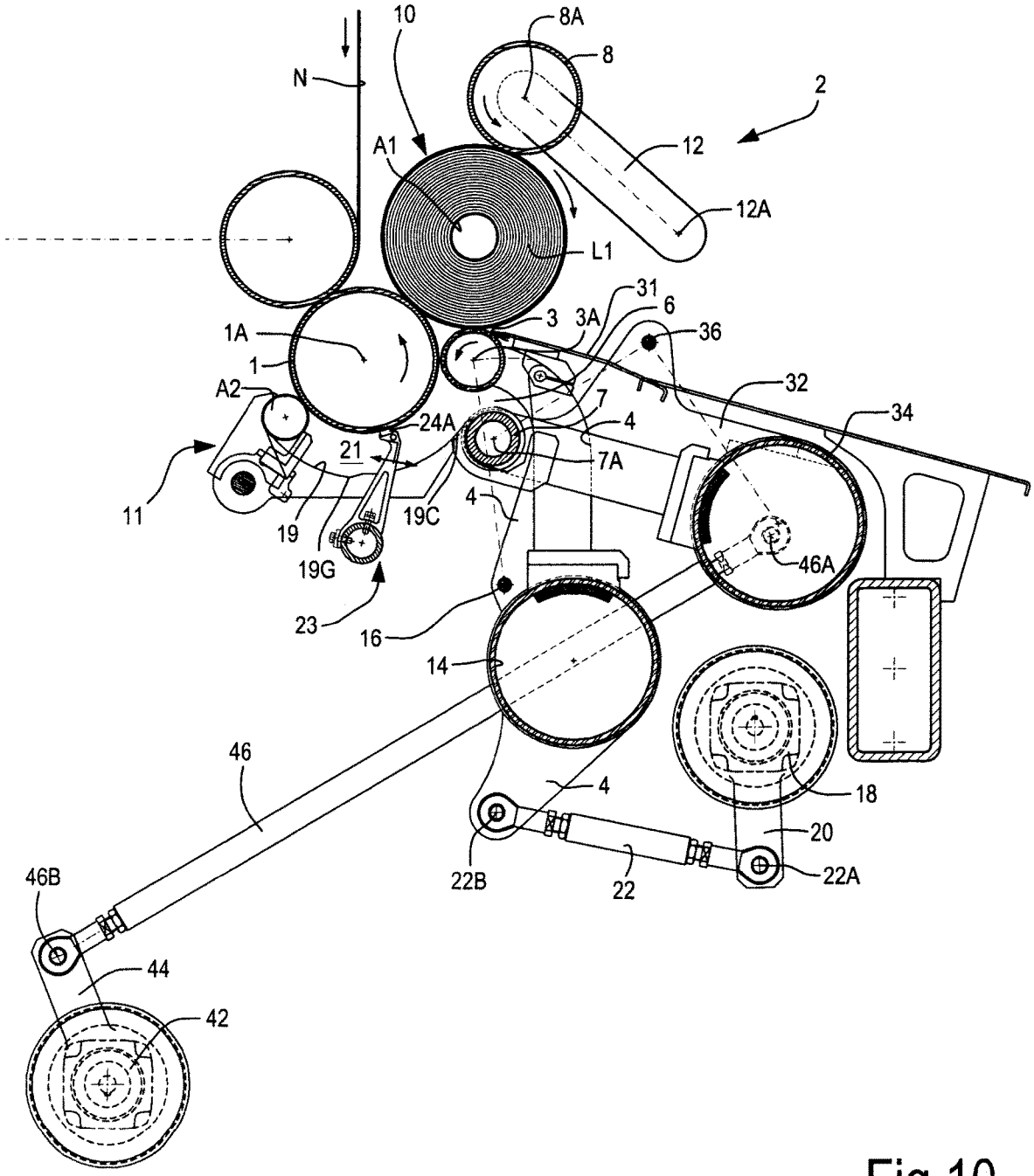

FIG. 10 shows a completed log L1, ready to be discharged from the second winding cradle 10, and a second winding core A2 already inserted into the first winding cradle 6, between the winding rollers 1, 3, 7. The operating condition shown in FIG. 10 can actually occur in the machine, but this is not indispensable. Depending on the type of regulation, the case in which the second winding core A2 reaches the position of FIG. 10 when the log L1 has already been ejected from the second winding cradle 10 can also occur.

Figure 11:
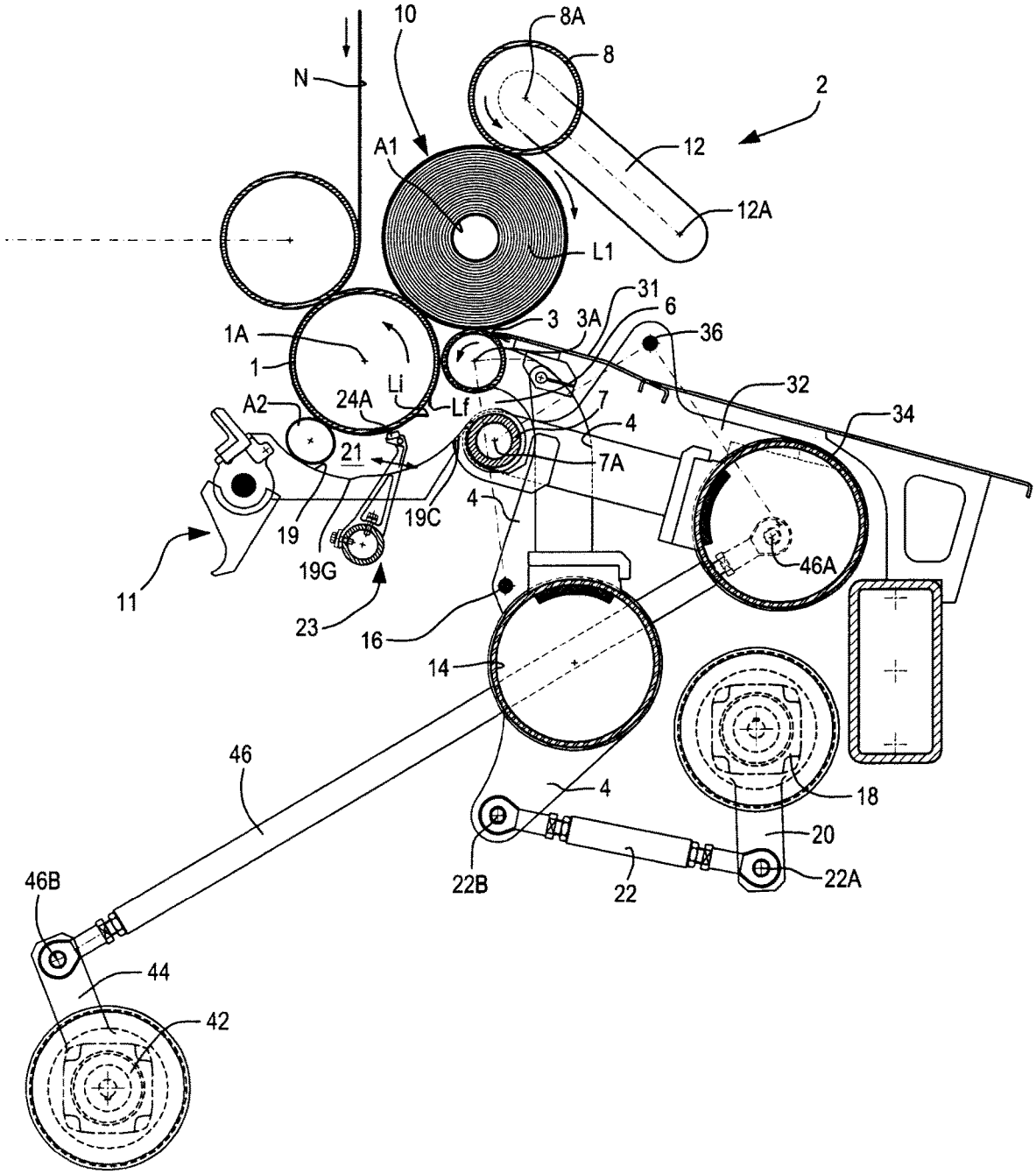

FIG. 11 shows a further step wherein the severing member 23 has pinched the web material N against the first winding roller 1 and a trailing edge Lf of the log L1 has been generated by tearing or severing the web material N. The new core A2 starts moving along the feed channel 21 by rolling on surface 19, in contact with said surface and with the web material N driven around the first winding roller 1. The severing member 23 has started its backward motion to move outside the feed channel 21.

Figure 12:
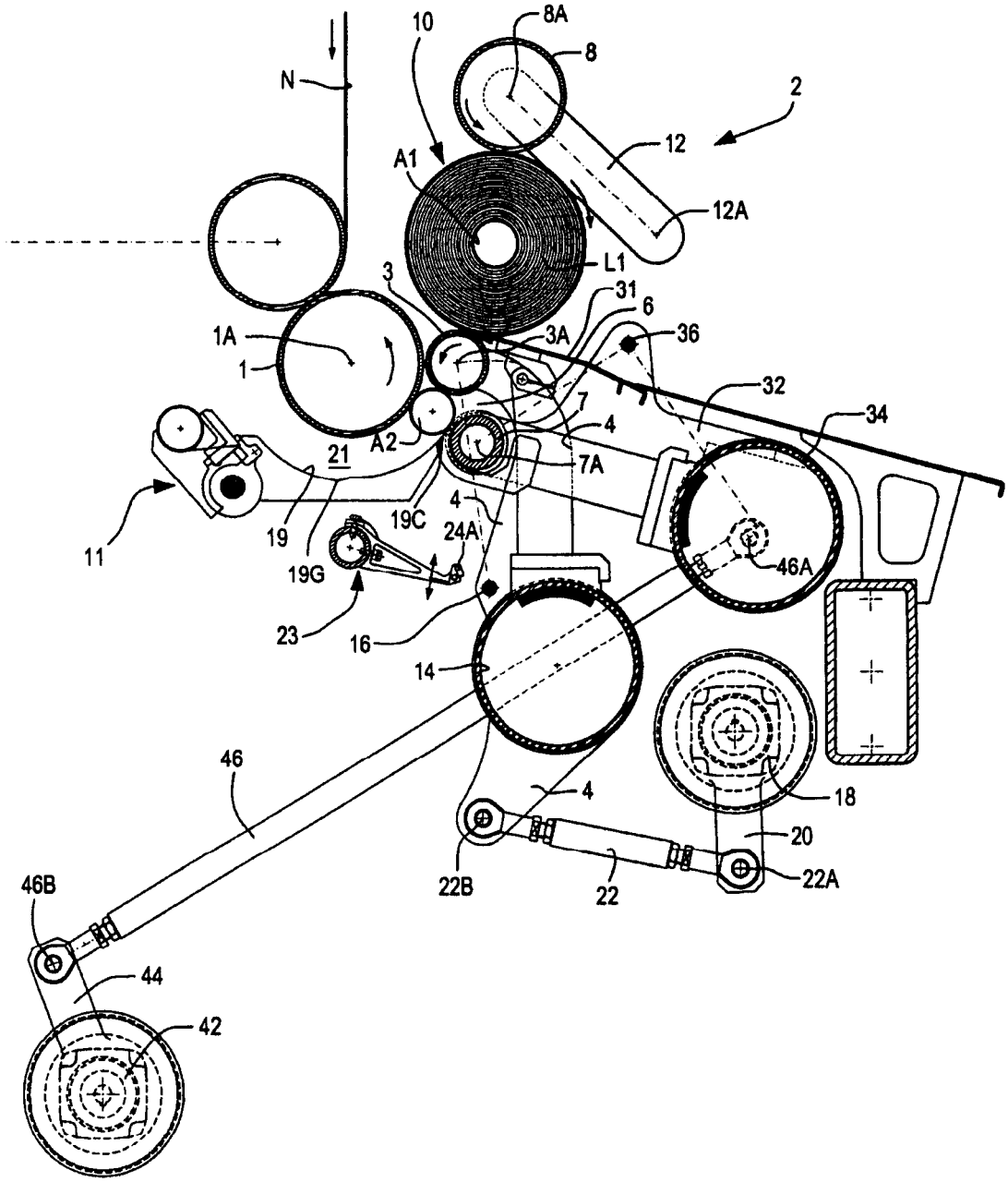

FIG. 12 shows the step wherein the new core A2 moves into and through the nip 5 between the first winding roller 1 and the second winding roller 3. The nip 5 can be widened to facilitate the transition through the nip 5 of the new core A2 and relevant log L2 which is under formation there around.

Figure 13:
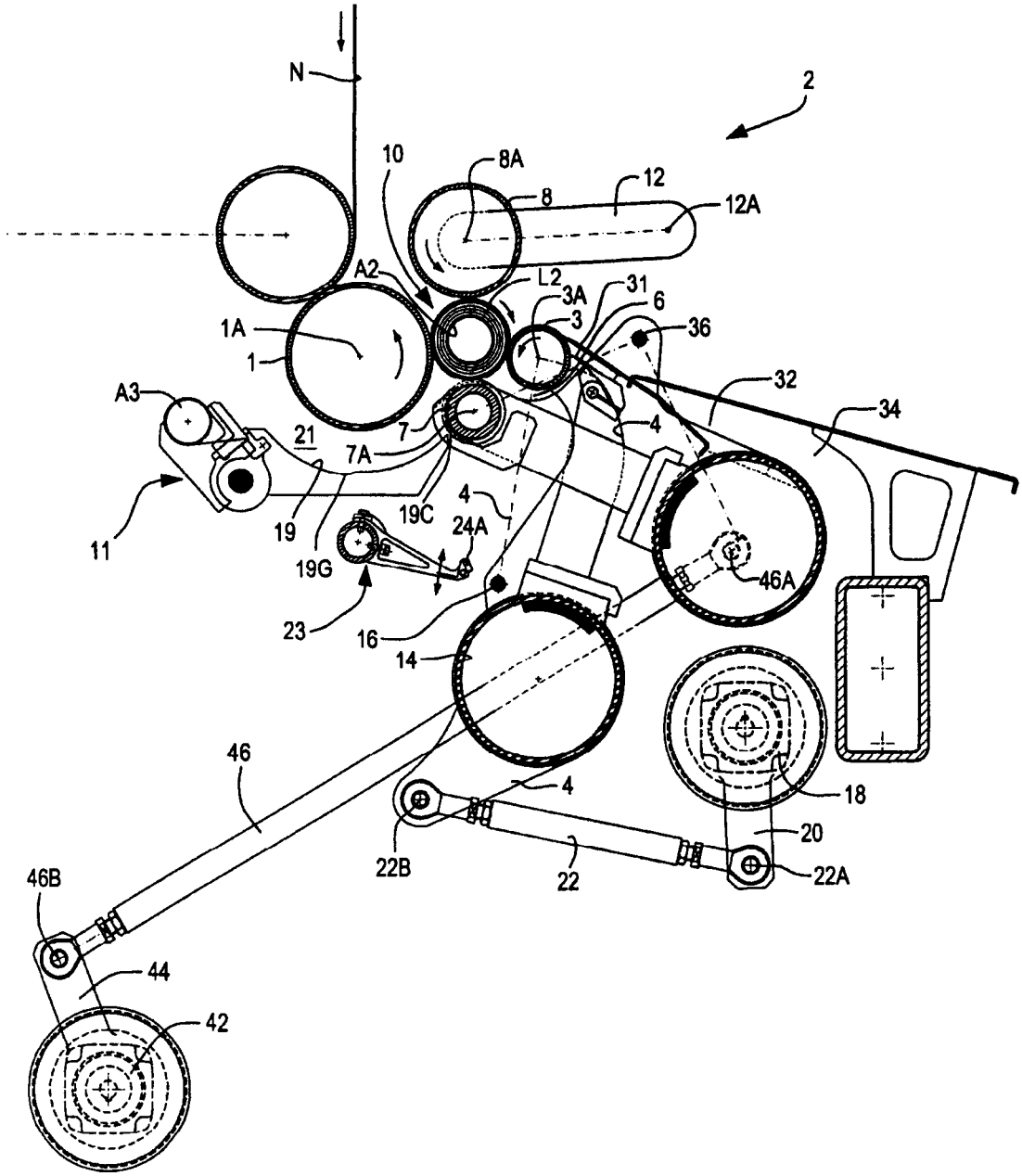
Figure 14:
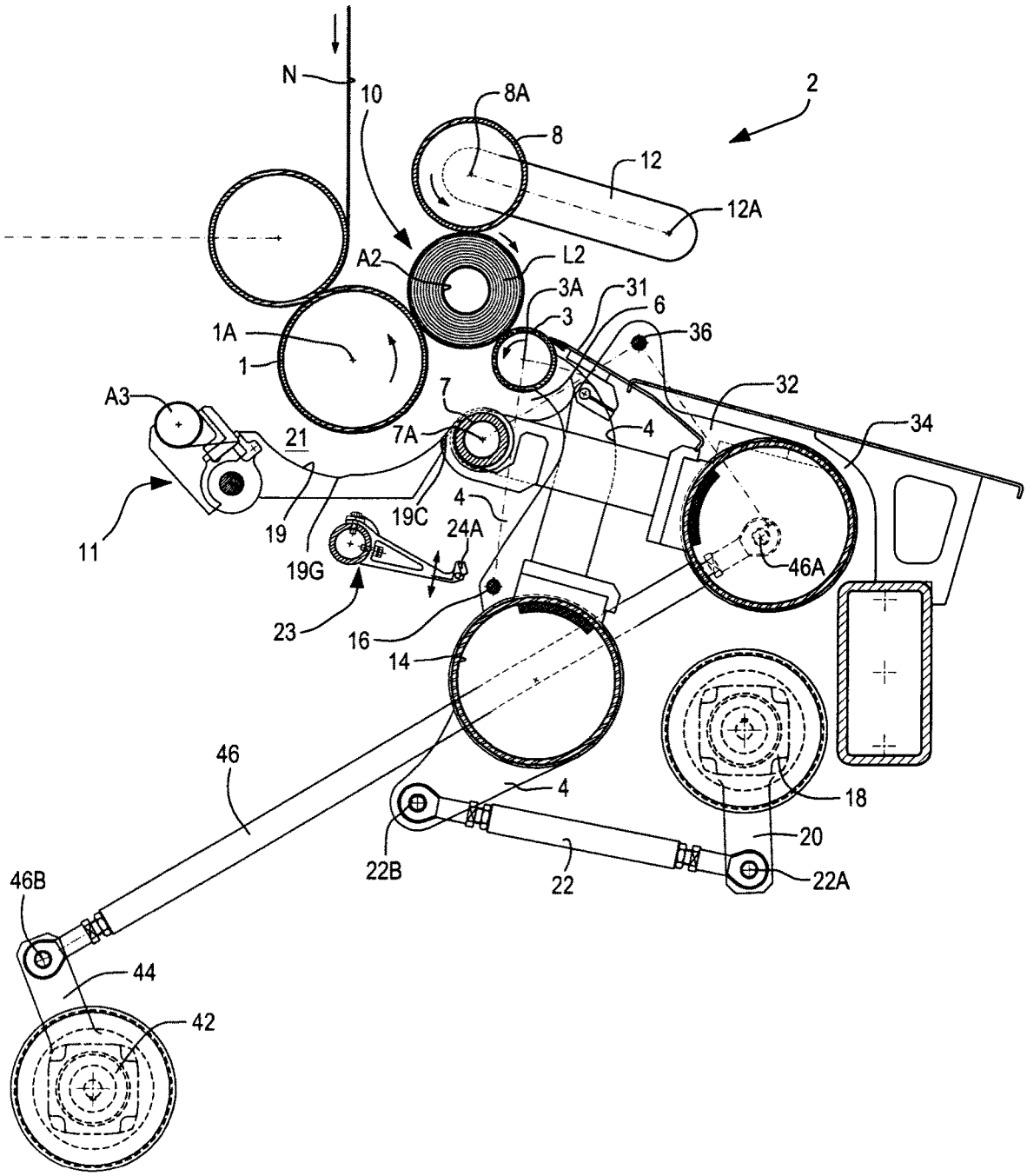

FIG. 13 shows the step in which the new log L2 is located in the second winding cradle 10, in contact with winding rollers 1, 3 and 8. The nip between rollers 1 and 3 can close again. The log L2 is almost completely wound in FIG. 14, which shows a step corresponding to the one of FIG. 9.

The passage of the second winding core A2, with the log L2 being formed there around, through the nip 5 defined by the first winding roller 1 and by the second winding roller 3 is allowed or facilitated by moving only the axis 3A of the second winding roller 3, while the axis 1A of the first winding roller 1 remains stationary with respect to the structure of the machine. In this way, the operation of the rewinding machine is made more uniform, in particular as the path of the winding material upstream of the nip 5 is not modified.

A further advantage of the embodiment of FIG. 9 consists in that operation of the severing member 23 of the web material N is simplified. In fact, it co-acts with a winding roller 1, whose rotation axis does not move and therefore control of the severing step of the web material N is simplified.

The use of a first winding roller 1 of larger diameter makes it possible to avoid the need for an intermediate support of the first winding roller 1, simplifying the structure of the machine and improving the quality of the logs.

Also in the embodiment of FIGS. 9, 10, 11, 12, 13 and 14 centers 101 can be provided to engage and guide the core A1, A2 through at least part of the winding cycle. While in the embodiment of FIGS. 1-8 the trajectory of the core is substantially rectilinear, and therefore the centers 101 can travel along a rectilinear path as well, in the embodiment of FIGS. 9-14 the center of the core moves along a more complex trajectory during winding of a log. Centers engaging and controlling the core need therefore to have more flexibility in their trajectory.

Figure 15:
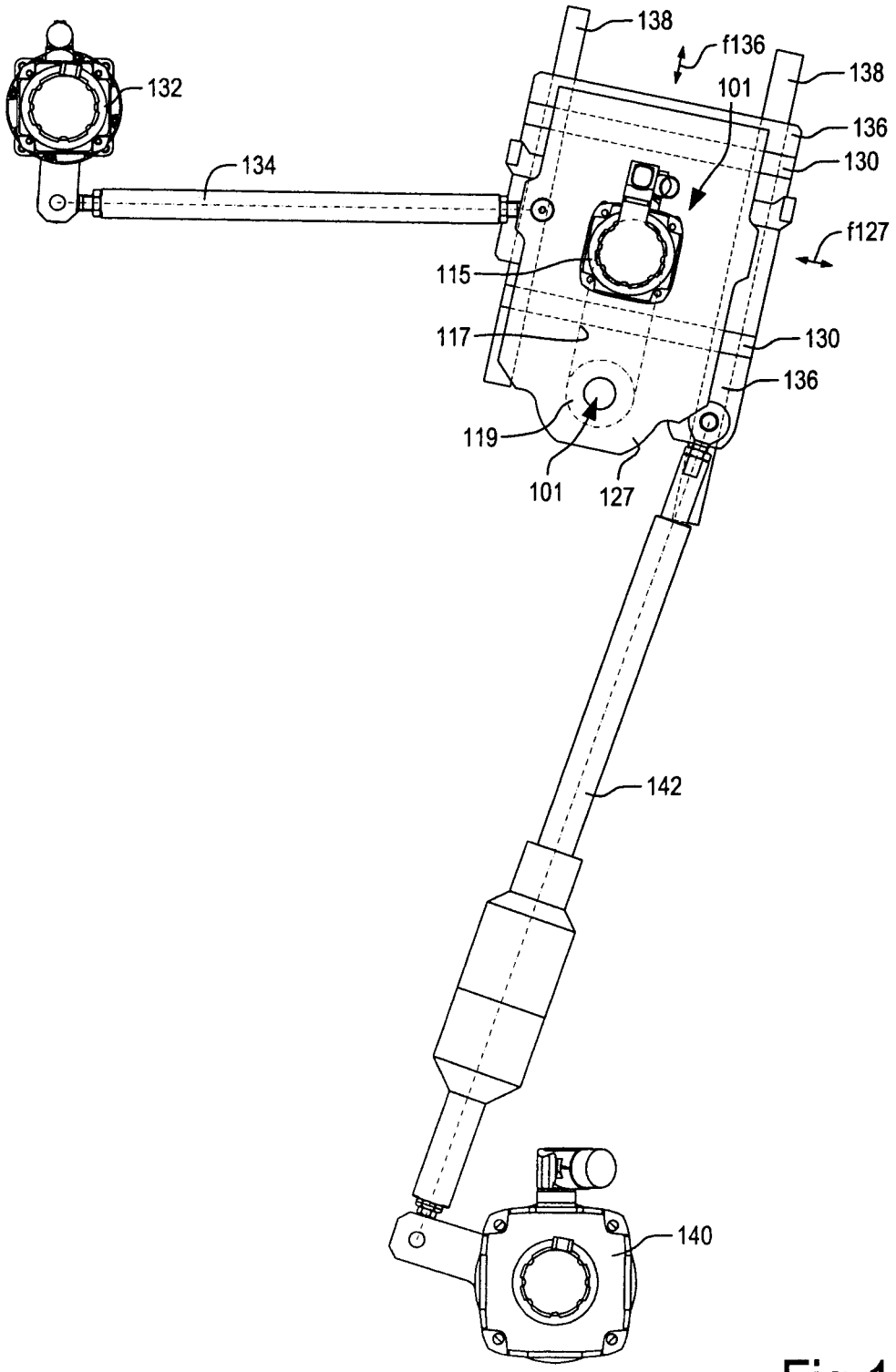
FIG. 15 shows a diagram of a system of motorized centers for guiding the unwinding cores in a further embodiment, specifically provided for the machine of FIGS. 9-14.

This can be achieved with a system as shown in FIG. 15. The same reference numbers as in FIG. 6 designate similar or corresponding elements. Each center 101 can be designed as shown in FIG. 7. The structure of each center 101 will not be described again. Each center 101 can be motor-driven by a first motor 115, e.g. an electric motor, through a belt or other flexible member 117 entrained around a pulley 119 coaxial to the center 101. If two centers are provided, one on each side of the machine, the same center and motor arrangement is duplicated on both sides of the machine. Similarly, also the guiding arrangement described below will be provided on both sides of the rewinding machine.

To provide a free trajectory for the centers 101, i.e. a trajectory that is not necessarily rectilinear, each center is supported on a first slide 127. The first slide is slidingly movable along first guides 130. The movement along guides 130 is controlled by an actuator, for instance a second electric motor 132, through a first connecting rod 134. Rotation of motor 132 causes the first slide to move in a controlled manner along guides 130 according to double arrow f127.

The guides 130 are in turn supported on a second slide 136. Said second slide 136 is slidingly movable along second guides 138, which can be integral with a supporting structure, not shown, which also supports the first winding roller 1 and other stationary members of the rewinding machine 2. The second guides 138 can be oriented at 90° with respect to the first guides 130, even though a different orientation can be selected. A 90° orientation makes programming of the movements easier.

Movement of the second slide 136 is controlled by a further actuator, for instance a third electric motor 140, e.g. through a second connecting rod 142. The movement of the second slide along guides 138 is pictorially represented by double-arrow f136.

The coordinated motion of slides 136 and 127 can generate any suitable trajectory for the axis of the respective center 101. The above described arrangements of slides, guides, connecting rods and actuator is provided for both centers 101 arranged on the two sides of the rewinding machine 2.

The above described arrangement of double guiding system and double actuation system allows control of the centers 101 along a trajectory that can be designed according to the trajectory followed by the winding cores, in all cases where such trajectory is non-rectilinear or not entirely rectilinear.

In the embodiment of FIG. 15, as well as in the embodiment of FIG. 6, the centers could be idle rather than motor-driven. Motor-driven centers can be preferred since they can provide a central winding motion, in combination with the peripheral winding motion imparted by the winding rollers. In some embodiment, the centers 101 could have an expandable element to engage the internal surface of the winding cores. In further embodiments, the centers 101 could have also an axial movement to and from the winding cores. The axial movement is orthogonal with respect to the slides 136 and 127 and could be used to engage and pull the winding cores, thus increasing the stiffness of the winding cores and so reducing the vibrations during the winding of the paper.

What is claimed is:

1. An automatic continuous peripheral rewinding machine for producing logs of web material wound around winding cores, comprising:

a first winding cradle formed between a first winding roller, a second winding roller and a third winding roller; the first winding roller and the second winding roller defining a nip through which the winding cores with the web material being wound there around pass;

a second winding cradle formed between the first winding roller, the second winding roller and a fourth winding roller; the third winding roller being placed upstream of the nip and the fourth winding roller being placed downstream of the nip, with respect to the direction of feed of the winding cores through the nip;

a rolling surface extending around the first winding roller and defining a winding core feed channel, between the rolling surface and the first winding roller; the rolling surface being configured and arranged with respect to the first winding roller such that the winding cores are fed by rolling in contact with the rolling surface and with the web material entrained around the first winding roller;

wherein the rolling surface comprises a first part stationary with respect to a supporting structure of the rewinding machine, and a second part that moves together with an axis of the third winding roller.

2. The rewinding machine as claimed in claim 1, further comprising a severing member of the web material adapted to sever the web material at the end of winding of a log in the second winding cradle.

3. The rewinding machine as claimed in claim 2, wherein the severing member is adapted to co-act with the first winding roller.

4. The rewinding machine as claimed in claim 3, wherein the severing member is adapted to pinch the web material against the first winding roller and sever the web material generating in the web material a tension greater than the breaking point of the web material.

5. The rewinding machine as claimed in claim 4, wherein the severing member is adapted to sever the web material between a new core introduced in the winding core feed channel and a log being formed in the second winding cradle between the severing member and the log being formed in the second winding cradle.

6. The rewinding machine as claimed in claim 3, wherein the severing member is adapted to enter the winding core feed channel and cooperate with the first winding roller in a point downstream of a winding core inserted into the winding core feed channel.

7. The rewinding machine as claimed in claim 2, wherein the severing member is adapted to pinch the web material against the first winding roller and sever the web material generating in the web material a tension greater than the breaking point of the web material.

8. The rewinding machine as claimed in claim 7, wherein the severing member is adapted to sever the web material between a new core introduced in the winding core feed channel and a log being formed in the second winding cradle between the severing member and the log being formed in the second winding cradle.

9. The rewinding machine as claimed in claim 2, wherein the severing member is adapted to enter the winding core feed channel and cooperate with the first winding roller in a point downstream of a winding core inserted into the winding core feed channel.

10. The rewinding machine as claimed in claim 2, wherein the rolling surface extends from an inlet of the winding core feed channel to the third winding roller.

11. The rewinding machine as claimed in claim 10, wherein a winding cores feed path extends beyond the winding core feed channel and between the first winding roller and the third winding roller, to reach the first winding cradle.

12. The rewinding machine as claimed in claim 1, wherein the rolling surface extends from an inlet of the winding core feed channel to the third winding roller.

13. The rewinding machine as claimed in claim 12, wherein a winding cores feed path extends beyond the winding core feed channel and between the first winding roller and the third winding roller, to reach the first winding cradle.

14. The rewinding machine as claimed in claim 1, wherein the first winding roller, the second winding roller, the third winding roller and the fourth winding roller are arranged to carry out a first part of winding of a log in the first winding cradle between the first winding roller, the second winding roller and the third winding roller and a last part of winding of a log in the second winding cradle, between the first winding roller, the second winding roller and the fourth winding roller.

15. The rewinding machine as claimed in claim 14, wherein the third winding roller and the fourth winding roller each have a movable axis and are adapted to move orthogonally to the axis following movement of the log during a step of log diameter increase and of transfer from the first winding cradle to the second winding cradle.

16. The rewinding machine as claimed in claim 1, wherein at least one of said first winding roller and said second winding roller has a movable axis, to control the distance between the first winding roller and the second winding roller and the dimension of the nip between the first winding roller and the second winding roller.

17. The rewinding machine as claimed in claim 1, wherein the first winding roller has a fixed axis and the second winding roller has a movable axis, and wherein the first winding roller has a larger diameter than the second winding roller.

18. The rewinding machine as claimed in claim 1, wherein movement of the first winding roller, of the second winding roller, of the third winding roller and of the fourth winding roller during winding of a log is provided so that: a first part of winding of the log takes place with the log in contact with the first winding roller, the second winding roller and the third winding roller; a second part of winding of the log takes place with the log in contact with the first winding roller, the second winding roller, the third winding roller and the fourth winding roller; a third part of winding of the log takes place with the log in contact with the first winding roller, the second winding roller and the fourth winding roller.

19. The rewinding machine as claimed in claim 1, further comprising a pair of centers, configured and arranged to engage with a winding core during at least a part of a winding cycle, the centers following the feed movement of the winding core between the winding rollers.

20. The rewinding machine of claim 19, wherein the centers are motor-driven.

21. The rewinding machine as claimed in claim 1, wherein the first winding roller, around which the web material is driven, has a diameter larger than a diameter of the second winding roller.

22. The rewinding machine as claimed in claim 1, wherein the first winding roller has an axis which is stationary with respect to a load-bearing structure of the rewinding machine, and the second winding roller has an axis which is movable with respect to the load-bearing structure of the machine, to allow or facilitate passage of a log being formed through the nip defined between the first winding roller and the second winding roller.

23. A method for winding a web material and sequentially forming logs of said web material wound around winding cores, comprising steps of:

feeding a web material around a first winding roller of a first winding cradle formed by the first winding roller, a second winding roller and a third winding roller, the first winding roller and the second winding roller defining, with a fourth winding roller, a second winding cradle;

inserting a first winding core into a feed channel formed between the first winding roller and a rolling surface extending around the first winding roller, and feeding the winding core by rolling in contact with the rolling surface and with the web material entrained around the first winding roller and feeding the first winding core along an insertion path between the first winding roller and the third winding roller and inserting the first winding core into the first winding cradle; wherein the rolling surface comprises a first part stationary with respect to a supporting structure of the rewinding machine, and a second part that moves together with an axis of the third winding roller;

carrying out a first part of a winding cycle of a first log around the first winding core in the first winding cradle, transferring the first log being formed from the first winding cradle into the second winding cradle through a nip defined between the first winding roller and the second winding roller;

carrying out a second part of a winding cycle of the first log in the second winding cradle;

at the end of winding of the first log in the second winding cradle, inserting a second winding core into the feed channel and along the insertion path between the first winding roller and the third winding roller and inserting the second winding core into the first winding cradle.

24. The method as claimed in claim 23, further comprising steps of: inserting the second winding core against the first winding roller pinching the web material between the second winding core and the first winding roller, and severing the web material between the first log in the second winding cradle and the second winding core.

25. The method as claimed in claim 24, further comprising a step of acting with a severing member on the web material to sever the web material thus generating a trailing edge of the first log and a leading edge with which to start winding a second log around the second winding core.

26. The method as claimed in claim 25, further comprising steps of: moving the third winding roller toward the nip between the first winding roller and the second winding roller in a step of forming the log; when the log is in contact with the fourth winding roller, moving the third winding roller from the nip and arranging the third winding roller in a position of cooperation with said severing member.

27. The method as claimed in claim 23, further comprising a step of acting with a severing member on the web material to sever the web material thus generating a trailing edge of the first log and a leading edge with which to start winding a second log around the second winding core.

28. The method as claimed in claim 27, further comprising a step of pinching the web material between the severing member and the first roller.

29. The method as claimed in claim 23, wherein between the first part of the winding cycle and the second part of the winding cycle, an intermediate part of the winding cycle is carried out, wherein the log being wound is in contact with the first winding roller, the second winding roller, the third winding roller and the fourth winding roller and moves across the nip between the first winding roller and the second winding roller.

30. The method of claim 23, further comprising a step of engaging the first winding core with centers and moving the centers with the winding core to follow a feed movement of the winding core between the first winding roller, the second winding roller and the third winding roller.

31. The method of claim 30, wherein the centers are motor-driven and transmit a winding motion to the core.

32. An automatic continuous peripheral rewinding machine for producing logs of web material wound around winding cores, comprising:

a first winding cradle formed between a first winding roller, a second winding roller and a third winding roller; the first winding roller and the second winding roller defining a nip through which the winding cores with the web material being wound there around pass;

a second winding cradle formed between the first winding roller, the second winding roller and a fourth winding roller; the third winding roller being placed upstream of the nip and the fourth winding roller being placed downstream of the nip, with respect to the direction of feed of the winding cores through the nip;

a rolling surface extending around the first winding roller and defining a winding core feed channel, between the rolling surface and the first winding roller; the rolling surface being configured and arranged with respect to the first winding roller such that the winding cores are fed by rolling in contact with the rolling surface and with the web material entrained around the first winding roller; wherein the rolling surface comprises a plurality of plates, each plate having a terminal distal end facing the third winding roller; wherein the third winding roller is provided with a series of annular grooves, and wherein each said terminal distal end of said plurality of plates protrude in said annular grooves of the third winding roller.

33. A method for winding a web material and sequentially forming logs of said web material wound around winding cores, comprising steps of:

feeding a web material around a first winding roller of a first winding cradle formed by the first winding roller, a second winding roller and a third winding roller, the first winding roller and the second winding roller defining, with a fourth winding roller, a second winding cradle;

inserting a first winding core into a feed channel formed between the first winding roller and a rolling surface extending around the first winding roller, and feeding the winding core by rolling in contact with the rolling surface and with the web material entrained around the first winding roller and feeding the first winding core along an insertion path between the first winding roller and the third winding roller and inserting the first winding core into the first winding cradle; wherein the rolling surface comprises a plurality of plates, each plate having a terminal distal end facing the third winding roller; wherein the third winding roller is provided with a series of annular grooves, and wherein each said terminal distal end of said plurality of plates protrude in said annular grooves of the third winding roller;

carrying out a first part of a winding cycle of a first log around the first winding core in the first winding cradle, transferring the first log being formed from the first winding cradle into the second winding cradle through a nip defined between the first winding roller and the second winding roller;

carrying out a second part of a winding cycle of the first log in the second winding cradle;

at the end of winding of the first log in the second winding cradle, inserting a second winding core into the feed channel and along the insertion path between the first winding roller and the third winding roller and inserting the second winding core into the first winding cradle.

* * * * *